US007851133B2

(12) United States Patent
Makino et al.

(10) Patent No.: US 7,851,133 B2
(45) Date of Patent: Dec. 14, 2010

(54) LITHOGRAPHIC PRINTING PROCESS

(75) Inventors: Naonori Makino, Shizuoka (JP); Toshifumi Inno, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/081,677

(22) Filed: Mar. 17, 2005

(65) Prior Publication Data

US 2005/0204943 A1 Sep. 22, 2005

(30) Foreign Application Priority Data

Mar. 19, 2004 (JP) ..... 2004-081226

(51) Int. Cl.

| | |
|---|---|
| ***G03C 1/00*** | (2006.01) |
| ***G03C 1/72*** | (2006.01) |
| ***G03C 7/00*** | (2006.01) |
| ***B41F 7/00*** | (2006.01) |

(52) U.S. Cl. ..... 430/300; 430/138; 430/286.1; 430/281.1; 101/450.1

(58) Field of Classification Search ..... 430/270.1, 430/281.1, 300, 138, 286.1, 288.1; 101/451
See application file for complete search history.

(56) References Cited

U.S. PATENT DOCUMENTS

| | | | | |
|---|---|---|---|---|
| 4,259,429 | A * | 3/1981 | Gilliams et al. | 430/124 |
| 5,368,973 | A * | 11/1994 | Hasegawa | 430/138 |
| 5,393,639 | A * | 2/1995 | Kourepenis | 430/254 |
| 5,569,573 | A * | 10/1996 | Takahashi et al. | 430/138 |
| 6,537,725 | B2 * | 3/2003 | Kunita et al. | 430/270.1 |
| 6,558,875 | B1 * | 5/2003 | Toshimitsu et al. | 430/302 |
| 6,596,455 | B2 * | 7/2003 | Yanaka et al. | 430/138 |
| 6,720,125 | B2 * | 4/2004 | Nakamura et al. | 430/157 |
| 6,796,236 | B2 * | 9/2004 | Mori | 101/460 |
| 6,815,137 | B2 * | 11/2004 | Hoshi et al. | 430/138 |
| 6,838,222 | B2 * | 1/2005 | Aoshima et al. | 430/176 |
| 7,001,704 | B2 * | 2/2006 | Oshima et al. | 430/138 |
| 2002/0048718 | A1 * | 4/2002 | Zheng et al. | 430/270.1 |
| 2003/0186174 | A1 * | 10/2003 | Nagase | 430/325 |
| 2003/0190555 | A1 * | 10/2003 | Nagase | 430/302 |
| 2004/0053163 | A1 * | 3/2004 | Fujita | 430/270.1 |

FOREIGN PATENT DOCUMENTS

| | | | |
|---|---|---|---|
| EP | 1096315 | A1 | 5/2001 |
| EP | 1334824 | A2 | 8/2003 |
| EP | 1442877 | A2 * | 8/2004 |
| JP | 2000089460 | A * | 3/2000 |
| JP | 2004243582 | A * | 9/2004 |
| JP | 2005041206 | A * | 2/2005 |

OTHER PUBLICATIONS

Suzuki, English Translation JP2000-089460 A, Photosensitive Lithographic Printing Plates Mar. 31, 2000.*

* cited by examiner

*Primary Examiner*—Cynthia H Kelly
*Assistant Examiner*—Connie P Johnson
(74) *Attorney, Agent, or Firm*—Birch, Stewart, Kolasch & Birch, LLP

(57) ABSTRACT

A lithographic printing process which comprises the steps of: imagewise scanning with a laser a presensitized lithographic plate which comprises a hydrophilic support and an image-recording layer containing a polymerization initiator, an ethylenically unsaturated polymerizable compound having no adherence to the hydrophilic support, and an ethylenically unsaturated polymerizable compound having adherence to the hydrophilic support and a molecular structure comprising a polyoxyalkylene group to polymerize the ethylenically unsaturated polymerizable compounds within the exposed area; removing the image-recording layer within the unexposed area from the lithographic plate mounted on a cylinder of a printing press; and then printing an image with the lithographic plate mounted on the cylinder of the printing press. A presensitized lithographic plate is also disclosed.

12 Claims, No Drawings

LITHOGRAPHIC PRINTING PROCESS

FIELD OF THE INVENTION

The present invention relates to a lithographic printing process. The invention also relates to a presensitized lithographic process.

BACKGROUND OF THE INVENTION

A lithographic printing plate generally comprises a hydrophobic imaging area, which receives oily ink in printing, and a hydrophilic non-imaging area (ink-repelling area), which receives dampening water. The lithographic printing process is essentially based on the fact that water is incompatible with oily ink. In the process, the ink is put on a surface of the plate unevenly so that only the imaging area may receive it, and then transferred onto an object (e.g., paper) to be printed.

For producing a lithographic printing plate, a presensitized printing plate (PS plate) comprising a hydrophilic support and a thereon-provided hydrophobic photosensitive resin layer (image-recording layer) has been conventionally used. The PS plate is masked and exposed to light through an original image (e.g., a lith film), and then the image-recording layer in the non-imaging area is dissolved and removed with an alkaline developing solution or organic solvent to bare imagewise the hydrophilic surface of the support and to leave the image-recording layer in the imaging area.

In the conventional process for producing the printing plate, the step of dissolving and removing the image-recording layer in the non-imaging area is indispensable. However, in these days, it has been wanted to omit or simplify an auxiliary wet-process such as developing process. From the viewpoint of protecting global environment, the whole industrial world pays attention to disposal of wastewater exhausted in the wet-process. Accordingly, in consideration of environment, it has been more and more wanted to omit the wet-process.

As a simple process for making a printing plate, a method called "press development" is proposed. In the press development, a presensitized plate after exposed to light is installed in a printing machine and then the image-recording layer in the non-imaging area is removed while the plate stays on the machine to print. The presensitized plate used in this development must have an image-recording layer partly removal in the non-imaging area during a normal printing process.

In the press development, for example, the image-recording layer in the non-imaging area can be dissolved or dispersed in dampening water, solvent of ink, or an emulsion of dampening water and ink. The layer may be mechanically removed when brought into contact with rollers or a blanket cylinder of the printing machine. Before removed mechanically with the rollers or cylinder, it may be beforehand swollen with dampening water or solvent of ink to weaken the cohesion of the layer or the adhesion onto the support.

In the present specification, the term "developing process" means a procedure in which a presensitized plate having been exposed to an IR laser beam is brought into contact with liquid (normally, alkaline developing solution) in an apparatus (normally, automatic developing machine) other than a printing machine so that the image-recording layer in the non-imaging area, where the laser beam was not applied, may be removed to bare a surface of the hydrophilic support and, as a result, to form an image in relief. On the other hand, the term "press development" means another procedure in which a presensitized plate having been exposed to an IR laser beam is brought into contact with liquid (normally, printing ink and/or dampening water) on a printing machine so that the layer in the non-imaging area may be removed to bare a surface of the hydrophilic support and, as a result, to form an image in relief.

In a conventional image-recording process, ultraviolet or visible light has been normally used. Even after exposed to the light, an image-recording layer of presensitized plate used in the conventional process is not fixed. Therefore, if a conventional presensitized plate is used in the press development, it is necessary to adopt a complicated process comprising, for example, a step of keeping the exposed presensitized plate under completely light-shielded condition or at a constant temperature until the plate is installed in a printing machine.

Meanwhile, digital information technology has been spread recently. In a process based on the digital information technology, image information in the form of digital data is electronically processed, stored and outputted by means of computers. Accordingly, various new image-forming methods for the digitized process have been proposed and practically adopted. For example, a presensitized lithographic printing plate is exposed not through a lith film but directly to highly directive and active radiation, such as a laser beam, scanning according to the digital image information, to produce a printing plate. This plate-making method, which is called "Computer-To-Plate (CTP)", has attracted the attention of people in this industrial field. Naturally, it is desired to provide a presensitized lithographic printing plate suitable for CTP.

As described above, in order to protect the global environment and to adapt to the digitization, it is desired more strongly than ever that the plate-making process be simplified and that the wet-process be omitted or converted to a dry-process.

Having recently been getting available at small cost, high-power lasers such as semi-conductor laser and YAG laser are expected to serve as image-recording means in a digitized plate-making process, in which a lithographic printing plate is produced by scanning exposure.

In the conventional process, the image-recoding layer is imagewise exposed to light of low or middle illuminance so that the properties of the layer material may be imagewise changed by photochemical reaction to record an image. On the other hand, in the process performed with a high-power laser, a great deal of photo-energy is applied to the area to be exposed for a very short period so that the photo-energy may be efficiently converted to thermal energy by which the properties (e.g., chemical characteristics, phase, form and/or structure) of the image-recoding layer in the exposed area are thermally changed to record an image. Accordingly, in the high-power laser process, image information is recorded by not only the photo-energy but also the thermal energy although inputted by only the photo-energy of laser beam. The recording process based on heat caused by exposure of high power density is generally called "heat-mode recording", and the procedure of converting the photo-energy to the thermal energy is called "light-heat conversion".

The plate-making process comprising the heat-mode recording has great advantages. For example, the image-recording layer used in the process is not sensitive to light of normal illuminance like room light, and it is not necessary to fix an image recorded with light of high illuminance in the image-recording layer. This means that there is no fear that room light impairs a presensitized lithographic printing plate used in the heat-mode recording and also that it is dispensable to fix the image recorded in the exposed presensitized plate. Accordingly, if an image-recording layer imagewise changed with a high-power laser to be soluble or insoluble is used in the plate-making process in which a lithographic printing plate is produced by the press development, the recorded image is not impaired even if the exposed image-recording layer is irradiated with room light. The heat-mode recording, therefore, is expected to make it possible to provide a presensitized lithographic printing plate suitable for the press development.

Laser technology has recently been remarkably developed, and high-power and downsized semi-conductor or solid-state lasers, which emit infrared rays in the wavelength range of 760 to 1,200 nm, have been getting easily available. These IR lasers are very suitably used as light-sources for recording images from which printing plates are directly produced according to digital date stored, for example, in computers.

However, since most practical photosensitive recording materials are sensitive to visible light of 760 nm or shorter, images cannot be recorded with IR lasers. It is, therefore, desired to provide a material so sensitive to infrared light that images can be recorded with IR lasers.

Japanese Patent No. 2,938,397 proposes a presensitized lithographic printing plate comprising a hydrophilic support and a thereon-provided image-forming layer made of hydrophilic binder and therein-dispersed particles of hydrophobic thermoplastic polymer to solve the above-mentioned problem. The proposed presensitized plate is exposed to an IR laser beam, to produce heat by which the particles of hydrophobic thermoplastic polymer are aggregated to form an image. The plate is then set on a cylinder of printing machine, and subjected to press development with printing ink and/or dampening water supplied.

The above process, in which the fine particles are simply aggregated by heat to form an image, is very suitable for the press development, but the formed image in relief (namely, the image-forming layer remaining in the image-forming area) has such poor durability (poor adhesion onto the support) that the plate wear is insufficient.

Japanese Patent Provisional Publication Nos. 2001-277740, 2001-277742 and 2002-137562 propose a presensitized lithographic printing plate comprising a hydrophilic support and a thereon-provided layer containing a polymerizable compound encased in microcapsules.

Japanese Patent Provisional Publication No. 2002-287334 proposes a presensitized lithographic printing plate comprising a support and a thereon-provided photosensitive layer containing an infrared absorber, a radical-polymerization initiator and a polymerizable compound.

The images in relief (imagewise remaining layers) given by the above processes, which are based on polymerization reactions, are made of substances having enough thickly formed chemical bonds to improve the durability, and accordingly they are stronger than the image in relief formed by melting and aggregating the fine particles of polymer. However, even so, from the practical viewpoint, they are still too unsatisfactory for the press development and have too poor plate wear and too low polymerization efficiency (sensitivity) to use practically.

Japanese Patent Provisional Publication No. 11(1999)-30858 proposes that a phosphoric ester having (meth)acryloyl group be incorporated as an additive into a presensitized lithographic printing plate. Japanese Patent Provisional Publication No. 10(1998)-333321 proposes another phosphoric ester as an additive for a presensitized lithographic printing plate to be subjected to the press development.

SUMMARY OF THE INVENTION

An object of the present invention is to provide a presensitized lithographic printing plate on which an image can be recorded by scanning with a laser.

Another object of the invention is to provide a lithographic printing process in which an image is directly recorded on the presensitized plate according to digital image information and then developed not by the developing process but by the press development.

A further object of the invention is to provide a lithographic printing process by which many sheets can be clearly printed with a lithographic printing plate produced with a practical amount of energy.

The present invention provides a lithographic printing process which comprises the steps of:

imagewise scanning with a laser a presensitized lithographic plate which comprises a hydrophilic support and an image-recording layer containing a polymerization initiator, an ethylenically unsaturated polymerizable compound having no adherence to the hydrophilic support, and an ethylenically unsaturated polymerizable compound having adherence to the hydrophilic support and a molecular structure comprising a polyoxyalkylene group to polymerize the ethylenically unsaturated polymerizable compounds within the exposed area;

removing the image-recording layer within the unexposed area from the lithographic plate mounted on a cylinder of a printing press; and then printing an image with the lithographic plate mounted on the cylinder of the printing press.

The invention also provides a presensitized lithographic plate which comprises a hydrophilic support and an image-recording layer containing an infrared absorbing dye, a polymerization initiator, an ethylenically unsaturated polymerizable compound having no adherence to the hydrophilic support, and an ethylenically unsaturated polymerizable compound having adherence to the hydrophilic support and a molecular structure comprising a polyoxyalkylene group, wherein the image-recording layer is removable with an ink or dampening water.

When the ethylenically unsaturated polymerizable compound having adherence to the hydrophilic support is exposed to light, the ethylenically unsaturated bond reacts to harden the compound together with the ethylenically unsaturated polymerizable compound having no adherence to the hydrophilic support. At the same time, the polymerized compounds firmly adhere on the hydrophilic support. As a result, a lithographic printing plate produced according to the present invention has excellent plate wear.

The present invention makes it possible to print many sheets clearly with a lithographic printing plate produced with a practical amount of energy.

In the present specification, it can be determined in the following manner whether a compound has adherence to the hydrophilic support or not.

First, the sample compound is dissolved in a compatible solvent to prepare a coating solution. The coating solution is then spread and dried to coat a support in the amount of 30 $mg/m^2$. Second, the support coated with the sample compound is washed well with the compatible solvent, and the amount of the compound remaining on the support is measured to determine how much the sample compound is adsorbed on the support. For measuring the amount of the adsorbed compound, the compound still staying on the support may be directly weighed or otherwise the compound removed and dissolved in the solvent may be quantitatively analyzed by, for example, X-ray fluorometry, reflective spectrophotometry or liquid chromatography.

If remaining in an amount of 1 $mg/m^2$ or more, the sample is regarded as the compound having adherence to the hydrophilic support. If remaining in an amount of less than 1 $mg/m^2$, the sample is regarded as the compound having no adherence to the hydrophilic support.

In the present specification, it can be determined in the following manner whether an image-recording layer is removable (with an ink or dampening water) or not.

With 1 weight part of dampening water (comprising 2 volume % of Ecolity 2, Fuji Photo Film Co., Ltd. and 98 volume % of water), 1 weight part of ink (Values G(N) Black, Dainippon Ink and Chemical, Inc.) is mixed and emulsified. An appropriate amount of the emulsion is coated on an image-recording layer on a hydrophilic support. While pressing the image-recording layer with a rubber roller, the roller moves back and forth on the image-recording layer ten times. If the image-recording layer is removed from the hydrophilic support, the sample is regarded as removable with an ink or dampening water.

DETAILED DESCRIPTION OF THE INVENTION

Ethylenically Unsaturated Polymerizable Compound Having Adherence to Hydrophilic Support The presensitized lithographic printing plate of the invention has an image-recording layer containing an ethylenically unsaturated polymerizable compound having adherence to the hydrophilic support. The ethylenically unsaturated polymerizable compound also has a molecular structure comprising a polyoxyalkylene group.

The ethylenically unsaturated polymerizable compound preferably has a functional group to be adsorbed onto the hydrophilic support.

The functional group to be adsorbed is a group capable of forming a chemical bond (e.g., ionic bond, hydrogen bond, coordination bond, bond of intermolecular force) with substance (e.g., metal, metal oxide) or another functional group (e.g., hydroxyl) existing on the surface of the hydrophilic support. The group to be adsorbed is preferably an acidic or cationic group.

The acidic group preferably has an acid dissociation constant of 7 or less. Examples of the acidic group include phenolic hydroxyl, carboxyl, $—SO_3H$, $—OSO_3H$, $—PO_3H_2$, $—OPO_3H_2$, $—CONHSO_2—$, $—SO_2NHSO_2—$ and $—COCH_2COCH_3$. Phenolic hydroxyl, carboxyl, $—SO_3H$, $—OSO_3H$, $—CONHSO_2—$, $—SO_2NHSO_2—$ and $—COCH_2COCH_3$ are preferred.

The cationic group is preferably an onium group. Examples of the onium group include an ammonium group, a phosphonium group, an arsonium group, a stibonium group, an oxonium group, a sulfonium group, a selenonium group, a stannonium group and an iodonium group. An ammonium group, a phosphonium group and a sulfonium group are preferred, an ammonium group and a phosphonium group are more preferred, and an ammonium group is most preferred.

Examples of the functional group capable of being adsorbed onto the surface of the hydrophilic support are shown below.

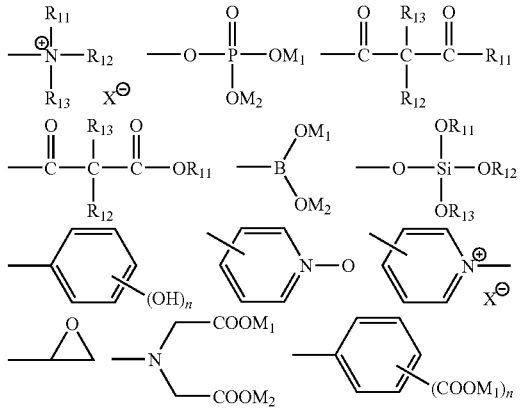

In the above, each of $R_{11}$ to $R_{13}$ is independently hydrogen, an alkyl group, an aryl group, an alkynyl group or an alkenyl group; each of $M_1$ and $M_2$ is independently hydrogen atom, a metal atom or an ammonium group; and $X^-$ is a counter ion.

Onium groups (e.g., an ammonium group, a pyridinium group), phosphoric ester groups, boric groups and β-diketone groups are particularly preferred.

The ethylenically unsaturated polymerizable compound also has a molecular structure comprising a polyoxyalkylene group. The polyoxyalkylene group is represented by $—(OC_mH_{2m})_n—$ (in which m is an integer of 1 or more, and n is an integer of 2 or more). The polyoxyalkylene group is preferably a polyoxyethylene structure. In other words, the polyoxyalkylene group is preferably represented by $—(OCH_2CH_2)_n—$ (in which n is an integer of 2 or more).

The compound having an ethylenically unsaturated bond and a functional group to be adsorbed onto the surface of the hydrophilic support is preferably represented by the following formula (I).

(I)

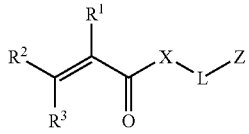

In the formula (I), each of $R^1$, $R^2$ and $R^3$ independently is hydrogen, a halogen atom or an alkyl group-having 1 to 6 carbon atoms. Each of $R^1$, $R^2$ and $R^3$ is preferably hydrogen or an alkyl group having 1 to 6 carbon atoms, more preferably hydrogen or an alkyl group having 1 to 3 carbon atoms, and most preferably hydrogen or methyl. Each of $R^2$ and $R^3$ is particularly preferably hydrogen.

In the formula (I), X is oxygen (—O—) or imino (—NH—), and preferably is oxygen.

In the formula (I), L is a divalent linking group comprising a polyoxyalkylene group. Preferably, L is a divalent aliphatic group (e.g., alkylene group, substituted alkylene group, alkenylene group, substituted alkenylene group, alkynylene group, substituted alkynylene group), a divalent aromatic group (e.g., arylene group, substituted arylene group) or a divalent hetero-cyclic group; or otherwise a combination thereof with oxygen (—O—), sulfur (—S—), imino (—NH—), substituted imino (—NR— in which R is an aliphatic group, an aromatic group or a heterocyclic group) or carbonyl (—CO—).

The aliphatic group can have a cyclic or branched structure. The aliphatic group preferably has 1 to 20, more preferably 1 to 15, and most preferably 1 to 10 carbon atoms. A saturated aliphatic group is preferred to an unsaturated one. The aliphatic group can have a substituent group. Examples of the substituent group include a halogen atom, hydroxyl, an aromatic group or a heterocyclic group.

The aromatic group has preferably 6 to 20, more preferably 6 to 15, and most preferably 6 to 10 carbon atoms. The aromatic group can have a substituent group. Examples of the substituent group include a halogen atom, hydroxyl, an aromatic group or a heterocyclic group.

The heterocyclic group preferably has a five- or six-membered heterocyclic ring. The heterocyclic ring can be condensed with another heterocyclic ring, an aliphatic ring or an aromatic ring. The heterocyclic group may have a substituent group. Examples of the substituent group include a halogen atom, hydroxyl, oxo (═O), thio (═S), imino (═NH), substituted imino (═N—R in which R is an aliphatic group, an aromatic group or a heterocyclic group), an aliphatic group, an aromatic group and a heterocyclic group.

The divalent linking group represented by L has two or more polyoxyalkylene structures. The polyoxyalkylene structure is preferably a polyoxyethylene structure. In other words, L preferably has a partial structure represented by $—(OCH_2CH_2)_n—$ (in which n is an integer of 2 or more).

In the formula (I), Z is a functional group capable of being adsorbed onto a surface of the hydrophilic support. The group to be adsorbed is described above.

Examples of the compound represented by the formula (I) are shown below.

(1)

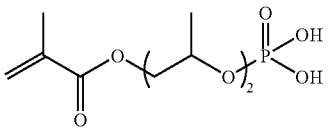

(2)

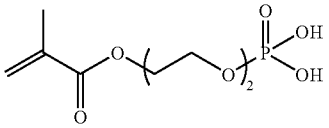

(3)

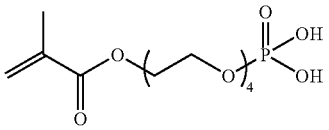

(4)

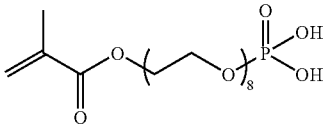

(5)

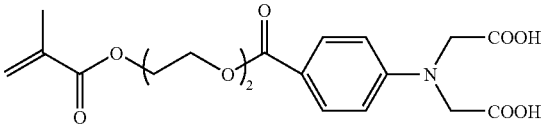

-continued (6)

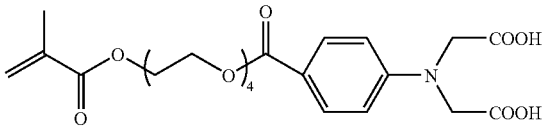

(7)

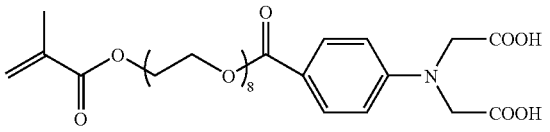

(8)

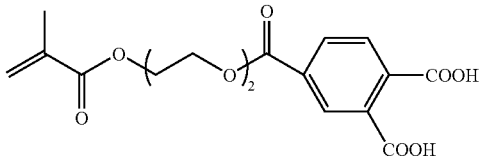

(9)

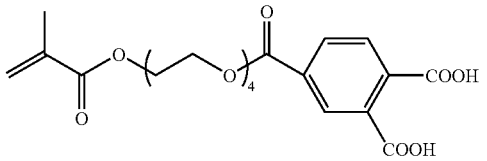

(10)

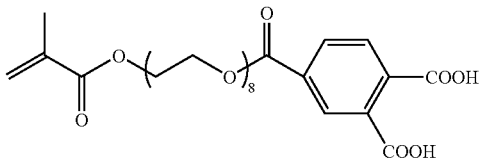

(11)

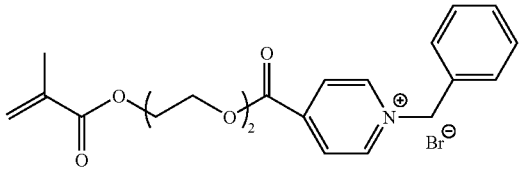

(12)

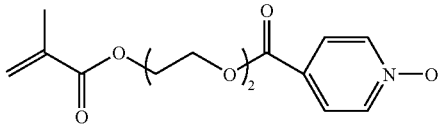

(13)

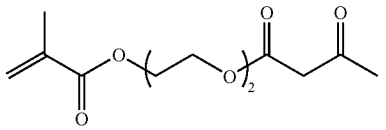

(14)

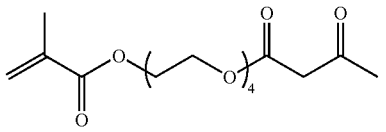

(15)

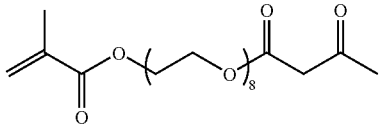

-continued
(16)
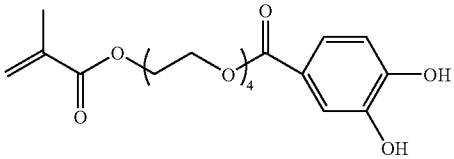
(17)
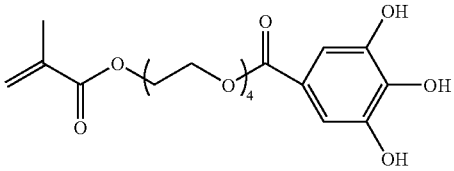
(18)
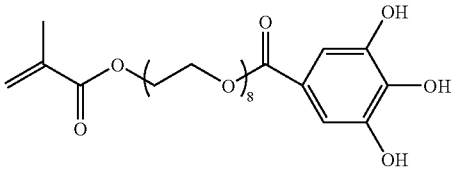
(19)
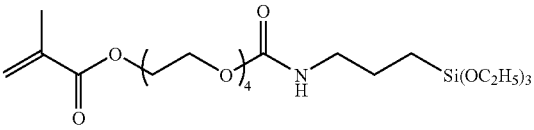
(20)
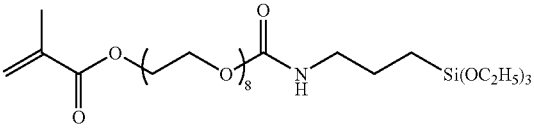
(21)
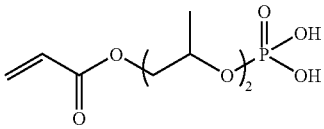
(22)
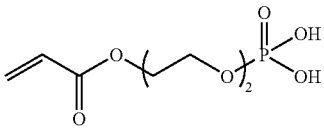
(23)
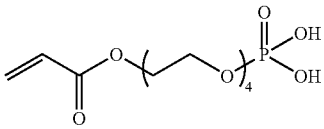
(24)
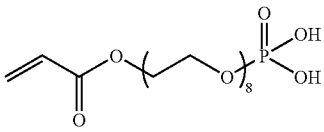
(25)
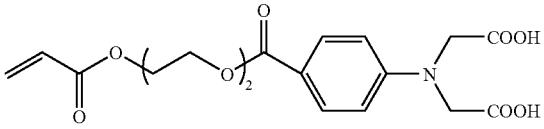
-continued
(26)
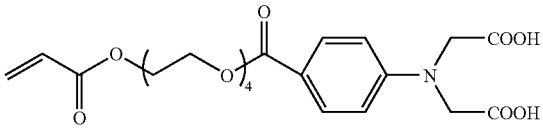
(27)
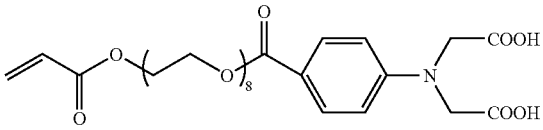
(28)
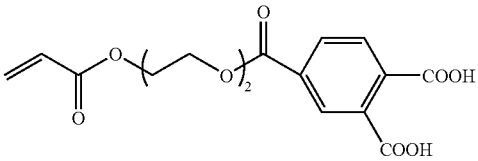
(29)
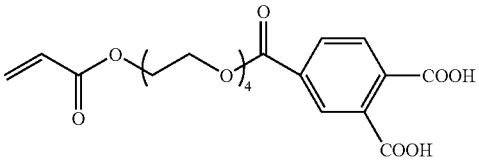
(30)
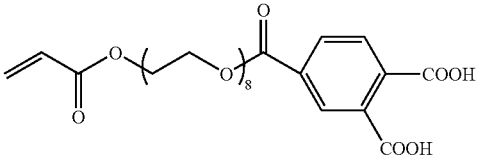
(31)
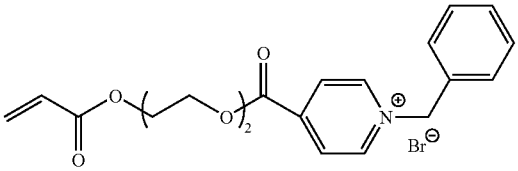
(32)
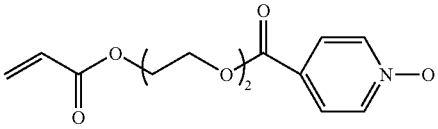
(33)
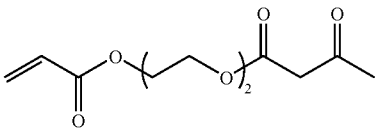
(34)
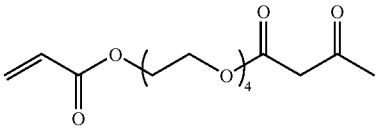
(35)
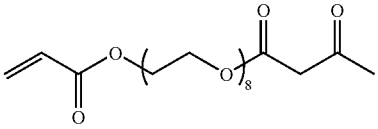

-continued (36)

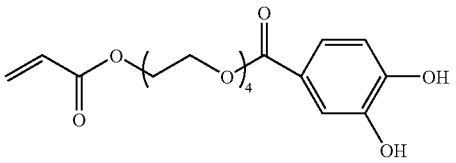

(37)

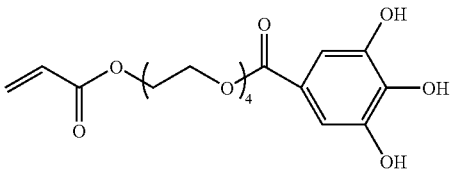

(38)

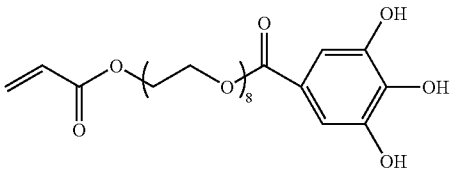

(39)

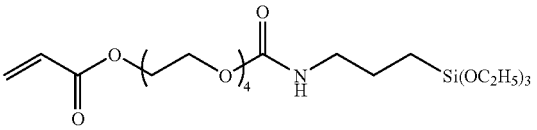

(40)

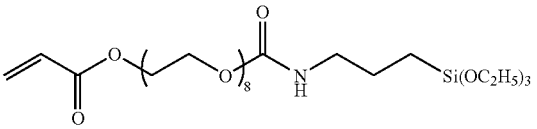

Two or more ethylenically unsaturated polymerizable compounds having adherence to the hydrophilic support can be used in combination.

The ethylenically unsaturated polymerizable compound having adherence to the hydrophilic support is contained together with a polymerization initiator, a polymerizable compound and an infrared-absorbing dye in the image-recording layer of the presensitized lithographic printing plate.

The amount of the ethylenically unsaturated polymerizable compound having adherence to the hydrophilic support is preferably in the range of 0.01 to 100 wt. %, and more preferably in the range of 0.1 to 50 wt. % based on the amount of the ethylenically unsaturated polymerizable compound having no adherence to the hydrophilic support.

(Infrared-Absorbing Dye)

An infrared (IR)-absorbing dye is used so that an image may be formed on the presensitized lithographic printing plate by means of a laser of light-source emitting an infrared ray of 760 to 1,200 nm. The infrared-absorbing dye has a function of converting the absorbed infrared ray to heat, by which the polymerization initiator (radical generator) described later is decomposed to generate radicals. The infrared-absorbing dye has an absorption maximum in the wavelength range of 760 to 1,200 nm.

The infrared-absorbing dye may be a commercially available dye or a known dye described in, for example, "Handbook of dyes (written in Japanese)", 1970, edited by The Society of Synthetic organic Chemistry, Japan. Examples of the infrared-absorbing dye include azo dyes, metal complex salt azo dyes, pyrazolone azo dyes, naphthoquinone dyes, anthraquinone dyes, phthalocyanine dyes, carbonium dyes, quinoneimine dyes, methine dyes, cyanine dyes, squarilium dyes, pyrylium dyes, and metal thiolato complexes.

Preferred dyes are, for example, cyanine dyes described in Japanese Patent Provisional Publication Nos. 58(1983)-125246, 59(1984)-84356 and 60(1985)-78787; methine dyes described in Japanese Patent Provisional Publication Nos. 58(1983)-173696, 58(1983)-181690 and 58(1983)-194595; naphthoquinone dyes described in Japanese Patent Provisional Publication Nos. 58(1983)-112793, 58(1983)-224793, 59(1984)-48187, 59(1984)-73996, 60(1985)-52940 and 60(1985)-63744; squarilium dyes described in Japanese Patent Provisional Publication No. 58(1983)-112792; and cyanine dyes described in British Patent No. 434,875.

Also preferred are, for example, near-infrared absorbing sensitizers described in U.S. Pat. No. 5,156,938; substituted arylbenzo(thio)pyrylium salts described in U.S. Pat. No. 3,881,924; trimethinethiapyrylium salts described in Japanese Patent Provisional Publication No. 57(1982)-142645 (U.S. Pat. No. 4,327,169); pyrylium compounds described in Japanese Patent Provisional Publication Nos. 58(1983)-181051, 58(1983)-220143, 59(1984)-41363, 59(1984)-84248, 59(1984)-84249, 59(1984)-146063 and 59(1984)-146061; cyanine dyes described in Japanese Patent Provisional Publication No. 59(1984)-216146; pentamethinethiopyrylium dyes described in U.S. Pat. No. 4,283,475; pyrylium compounds described in Japanese Patent Publication Nos. 5(1993)-13514 and 5(1993)-19702; and near infrared-absorbing dyes disclosed in U.S. Pat. No. 4,756,993.

Still preferred are particular indoleninecyanine dyes described in Japanese Patent Application Nos. 2001-6326 and 2001-237840. Examples of them are shown below.

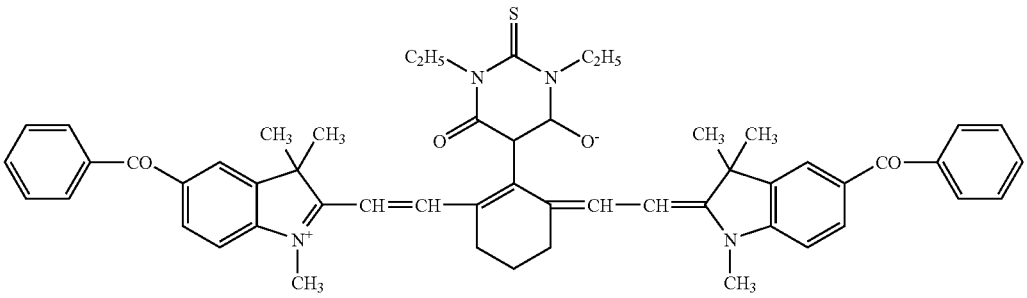

-continued

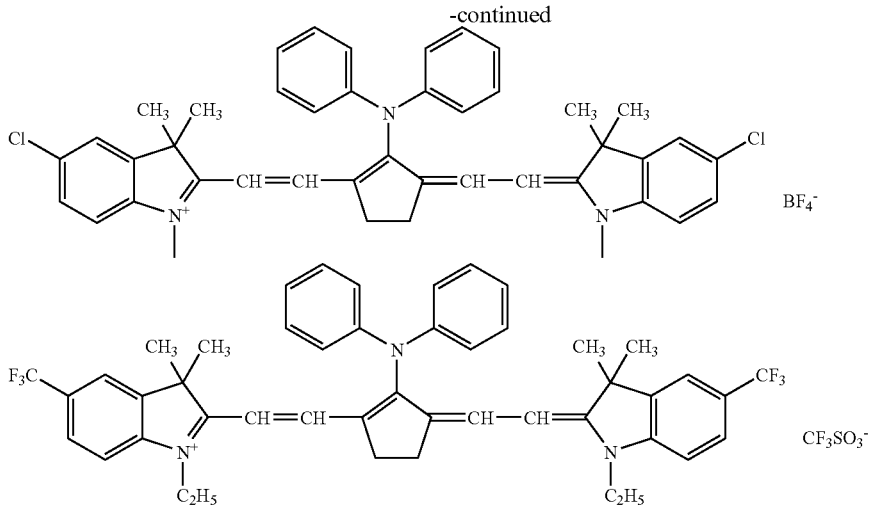

Formula (i):

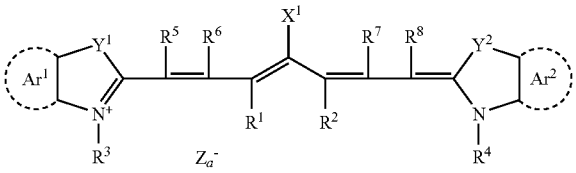

In the formula (i), $X^1$ is a hydrogen atom, a halogen atom, —$NPh_2$, $X^2$-$L^1$ or the group shown below. Here, $X^2$ is an oxygen atom, a nitrogen atom or a sulfur atom; and $L^1$ is a hydrocarbon group having 1 to 12 carbon atoms, an aromatic group having a hetero atom or a hetero atom-containing hydrocarbon group having 1 to 12 carbon atoms. The term "hetero atom" means N, S, O, Se or a halogen atom. In the group shown below, $Xa^-$ is the same as $Z^{1-}$ described later and $R^a$ is a substituent group selected from the group consisting of hydrogen, an alkyl group, an aryl group, a substituted or non-substituted amino group and a halogen atom.

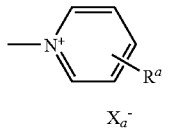

In the formula (i), each of $R^1$ and $R^2$ is independently a hydrocarbon group having 1 to 12 carbon atoms. Each of $R^1$ and $R^2$ is preferably a hydrocarbon group having 2 or more carbon atoms because a coating solution containing that dye for forming the recording layer has good shelf life. It is particularly preferred that $R^1$ and $R^2$ be combined to form a five- or six-membered ring.

In the formula (i), each of $Ar^1$ and $Ar^2$ is independently a substituted or non-substituted aromatic hydrocarbon group. They may be the same or different from each other. Preferred examples of the aromatic hydrocarbon group include benzene ring and naphthalene ring. Preferred examples of the substituent group include a hydrocarbon group having 12 or less carbon atoms, a halogen atom, and an alkoxy group having 12 or less carbon atoms. Each of $Y^1$ and $Y^2$ is independently a sulfur atom or a dialkylmethylene group having 12 or less carbon atoms, and they may be the same or different from each other. Each of $R^3$ and $R^4$ is independently a substituted or non-substituted hydrocarbon group having 20 or less carbon atoms, and they may be the same or different from each other. Preferred examples of the substituent group include an alkoxy group having 12 or less carbon atoms, carboxyl and sulfo. Each of $R^5$, $R^6$, $R^7$ and $R^8$ is independently a hydrogen atom or a hydrocarbon group having 12 or less carbon atoms, preferably a hydrogen atom in consideration of availability. They may be the same or different from each other. In the formula (i), $Za^-$ is a counter anion. In the case where the cyanine dye of the formula (i) has an anionic substituent group in its structure and hence where it is unnecessary to neutralize the charge, $Za^-$ may be omitted. The counter anion $Za^-$ is preferably a halogen ion, perchlorate ion, tetrafluoroborate ion, hexafluorophosphate ion and sulfonic ion, more preferably perchlorate ion, hexafluorophosphate ion and arylsulfonic ion because a coating solution containing that dye for forming the recording layer has good shelf life.

Preferred examples of the cyanine dye represented by the formula (i) are described in Japanese Patent Provisional Publication No. 2001-133969. The afore-mentioned particular indoleninecyanine dyes described in Japanese Patent Application Nos. 2001-6326 and 2001-237840 are also preferably used.

The infrared-absorbing dye may be incorporated in a layer together with other components, or otherwise may be added in another layer separately from other components. The infrared-absorbing dye is incorporated so that an image-recording layer of the resultant negative presensitized lithographic printing plate may have an absorbance of 0.3 to 1.2, preferably 0.4 to 1.1 determined by reflective spectrophotometry at the absorption maximum in the wavelength region of 760 to 1,200 nm. If the absorbance is in the above range, the polymerization reaction proceeds so evenly in depth of the image-recording layer that the resultant image in relief has satisfying film-strength and sufficient adhesion onto the support.

The absorbance of image-recording layer can be controlled by adjusting the amount of infrared-absorbing dye and the thickness of image-recording layer. The absorbance can be measured in the known manner. For example, an image-recording layer having a thickness enough to produce a lithographic printing plate is formed on a reflective support made of, for example, aluminum; and then the reflection density is measured by means of an optical densitometer. Otherwise, the absorbance may be measured by means of a spectrophotometer equipped with an integrating sphere.

(Polymerization Initiator)

The polymerization initiator generates radicals when receiving thermal- and/or photo-energy, and thereby starts and accelerates polymerization of the compound having polymerizable unsaturated groups. The polymerization initiator usable in the invention is, for example, a known thermal polymerization initiator, a compound having a bond of small bond-dissociation energy or a photopolymerization initiator. The radical generator preferably used in the invention generates radicals when receiving thermal energy, and thereby starts and accelerates polymerization of the compound having polymerizable unsaturated groups. As the thermal radical generator, known polymerization initiators and compounds having bonds of small bond-dissociation energy can be optionally selected to use in the invention. The compound generating radials may be used singly or in combination.

Examples of the compound generating radials include organic halogenated compounds, carbonyl compounds, organic peroxides, polymerization initiators of azo type, azide compounds, metallocene compounds, hexaarylbiimidazole compounds, organic boric compounds, disulfonic compounds, oxime esters and onium salts.

Examples of the organic halogenated compounds are described in, for example, "Bull. Chem. Soc. Japan", 42(1969), 2924, Wakabayasshi et al.; U.S. Pat. No. 3,905,815; Japanese Patent Publication No. 46(1971)-4605; Japanese Patent Provisional Publication Nos. 48(1973)-36281, 55(1980)-3207b, 60(1985)-239736, 61((1986)-169835, 61(1986)-169837, 62(1987)-58241, 62(1987)-212401, 63(1988)-70243, 63(1988)-298339; and "Journal of Heterocyclic Chemistry", 1 (No. 3), 1970. Particularly preferred are trihalomethyl-substituted oxazole compounds and s-triazine compounds.

More preferred is an s-triazine derivative having an s-triazine ring combined with at least one mono-, di- or tri-halogen-substituted methyl group. Examples of the s-triazine derivative include 2,4,6-tris(monochloromethyl)s-triazine, 2,4,6-tris(dichloromethyl)-s-triazine, 2,4,6-tris(trichloromethyl)-s-triazine, 2-methyl-4,6-bis(trichloromethyl)-s-triazine, 2-n-propyl-4,6-bis(trichloromethyl)-s-triazine, 2-(α,α,β-trichloroethyl)-4,6-bis(trichloromethyl)-s-triazine, 2-phenyl-4,6-bis(trichloromethyl)-s-triazine, 2-(p-methoxyphenyl)-4,6-bis(trichloromethyl)-s-triazine, 2-(3,4-epoxyphenyl)-4,6-bis(tri-chloromethyl)-s-triazine, 2-(p-chlorophenyl)-4,6-bis(tri-chloromethyl)-s-triazine, 2-[1-(p-methoxyphenyl)-2,4-butadienyl]-4,6-bis(trichloromethyl)-s-triazine, 2-styryl-4,6-bis(trichloromethyl)-s-triazine, 2-(p-methoxystyryl)-4,6-bis(trichloromethyl)-s-triazine, 2-(p-isopropyloxystyryl)-4,6-bis(trichloromethyl)-s-triazine, 2-(p-tolyl)-4,6-bis(trichloromethyl)-s-triazine, 2-(4-naphoxybaphthyl)-4,6-bis(trichloromethyl)-s-triazine, 2-phenylyhio-4,6-bis(trichloromethyl)-s-triazine, 2-benzylyhio-4,6-bis(tri-chloromethyl)-s-triazine, 2,4,6-tris(dibromomethyl)-s-triazine, 2-methyl-4,6-bis(dibromomethyl)-s-triazine, and 2-methoxy-4,6-bis(dibromomethyl)-s-triazine.

Examples of the carbonyl compounds include benzophenone and derivatives thereof such as Michler's ketone, 2-methylbenzophenone, 3-methyl-benzophenone, 4-methylbenzophenone, 2-chlorobenzophenone, 4-bromobenzophenone and 2-carboxybenzophenone; acetophenone derivatives such as 2,2-dimethoxy-2-phenylacetophenone, 2,2-diethoxyacetophenone, 1-hydroxycyclohexylphenyl ketone, α-hydroxy-2-methylphenyl-propanone, 1-hydroxy-1-methylethyl-(p-isopropylphenyl)-ketone, 1-hydroxy-1-(p-dodecylphenyl)ketone, 2-methyl-(4'-(methylthio)phenyl)-2-morpholino-1-propanone and 1,1,1-trichloromethyl-(p-butylphenyl)ketone; thioxanthone and derivatives thereof such as 2-ethylthioxanthone, 2-isopropylthioxanthone, 2-chlorothioxanthone, 2,4-dimethyl-thioxanthone, 2,4-diethylthioxanthone, and 2,4-diisopropyl-thioxanthone; and benzoic ester derivatives such as ethyl p-dimethylaminobenzoate and ethyl p-diethylaminobenzoate.

Examples of the azo compounds are described in Japanese Patent Provisional Publication No. 8(1996)-108621.

Examples of the organic peroxides include trimethylcyclohexanone peroxide, acetylacetone peroxide, 1,1-bis(tert-butylperoxy)-3,3,5-trimethylcyclohexane, 1,1-bis(tert-butylperoxy)cyclohexane, 2,2-bis(tertbutylperoxy) butane, tert-butyl hydroperoxide, cumene hydroperoxide, diisopropylbenzene hydroperoxide, 2,5-dimetylhexane-2,5-dihydroperoxide, 1,1,3,3-tetramethylbutyl hydroperoxide, tert-butylcumyl hydroperoxide, dicumyl peroxide, 2,5-dimethyl-2,5-di(tert-butylperoxy)hexane, 2,5-oxanoyl peroxide, succinic acid peroxide, benzoyl peroxide, 2,4-dichlorobenzoyl peroxide, diisopropylperoxycarbonate, di-2-ethylhexylperoxydicarbonate, di-2-ethoxyethylperoxydicarbonate, dimethoxyisopropylperoxycarbonate, di(3-methyl-3-methoxybutyl)peroxycarbonate, tert-butylperoxyacetate, tert-butylperoxypivalate, tert-butylperoxyneodecanoate, tert-butylperoxyoctanoate, tertbutylperoxylaurate, tersyl carbonate, 3,3',4,4'-tetra(t-butylperoxycarbonyl)benzophenone, 3,3',4,4'-tetra(t-hexylperoxycarbonyl)benzophenone, 3,3',4,4'-tetra(p-isopropylcumylperoxycarbonyl)benzophenone, carbonyl di(t-butylperoxydihydrogendiphtharate), and carbonyldi(t-hexylperoxydihydrogendiphtharate).

The metallocene compounds are described in Japanese Patent Provisional Publication Nos. 59(1984)-152396, 61(1986)-151197, 63(1988)-41484, 2(1990)-249, 2(1990)-4705 and 5(1993)-83588. Examples of the metallocene compounds include dicyclopentadienyl-Ti-bis-phenyl, dicyclopenta-dienyl-Ti-bis-2,6-difluorophen-1-yl, dicyclopentadienyl-Ti-bis-2,4-difluorophen-1-yl, dicyclopentadienyl-Ti-bis-2,4,6-trifluorophen-1-yl, dicyclopentadienyl-Ti-bis-2,3,5,6-tetrafluorophen-1-yl, dicyclopentadienyl-Ti-bis-2,3,4,5,6-pentafluorophen-1-yl, dimethylcyclopentadienyl-Ti-bis-2,6-difluorophen-1-yl, dimethylcyclopentadienyl-Ti-bis-2,4,6-trifluorophen-1-yl, dimethylcyclopentadienyl-Ti-bis-2,3,5,6-tetrafluorophen-1-yl, dimethylcyclopenta-dienyl-Ti-bis-2,3,4,5,6-pentafluorophen-1-yl, and iron-allene complexes described in Japanese Patent Provisional Publication Nos. 1(1999)-304453 and 1(1999)-152109.

The hexaarylbiimidazole compounds are described in, for example, Japanese Patent Publication No. 6(1994)-29285, U.S. Pat. Nos. 3,479,185, 4,311,783 and 4,622,286. Examples of the hexaarylbiimidazole compounds include 2,2'-bis(o-chlorophenyl)-4,4',5,5'-tetraphenylbiimidazole, 2,2'-bis(o-bromophenyl)-4,4',5,5'-tetraphenylbiimidazole, 2,2'-bis(o,p-dichlorophenyl)-4,4',5,5'-tetraphenylbiimidazole, 2,2'-bis(o-chlorophenyl)-4,4',5,5'-tetra(m-methoxyphenyl)biimidazole, 2,2'-bis(o,o'-dichlorophenyl)-4,4',5,5'-tetraphenylbiimidazole, 2,2'-bis(o-nitrophenyl)-4,4',5,5'-tetraphenylbiimidazole, 2,2'-bis(o-methylphenyl)-4,4',5,5'-tetraphenylbiimidazole, and 2,2'-bis(o-trifluorophenyl)-4,4',5,5'-tetraphenylbiimidazole.

The organic boric compounds are, for example, described in Japanese Patent Provisional Publication Nos. 62(1987)-143044, 62(1987)-150242, 9(1997)-188685, 9(1997)-188686, 9(1997)-188710, 2000-131837, 2002-107916, Japanese Patent No. 2,764,769, and Japanese Patent Application No. 2000-310808. Examples of the organic boric compounds include organic boric salts described in, for example, "Rad. Tech'98, Proceeding, Apr. 19-22, 1998, Chicago", Kunz, Martin; organic boron sulfonium complexes and organic boron oxosulfonium complexes described in Japanese Patent Provisional Publication Nos. 6(1994)-157623, 6(1994)-175564, 6(1994)-175561; organic boron iodonium complexes described in Japanese Patent Provisional Publication Nos. 6(1994)-175554, 6(1994)-175553; organic boron phosphonium complexes described in Japanese Patent Provisional Publication No. 9(1997)-188710; and organic boron transition metal coordinated complexes described in Japanese Patent Provisional Publication Nos. 6(1994)-348011, 7(1995)-128785, 7(1995)-140589, 7(1995)-306527 and 7(1995)-292014.

Examples of the disulfonic compounds are described in Japanese Patent Provisional Publication No. 61(1986)-166544 and Japanese Patent Application No. 2001-132318.

The oxime esters are described in J.C.S. Perkin II (1973), 1653 to 1660; J.C.S. Perkin II (1979), 156 to 162; Journal of Photopolymer Science and Technology (1995), 202 to 232; Japanese Patent Provisional Publication Nos. 2000-66385 and 2000-80068. Examples of the oxime esters are shown below.

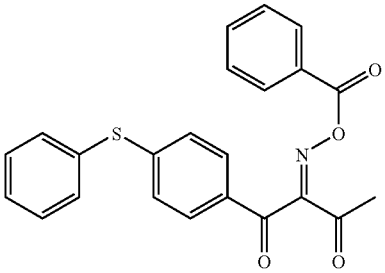

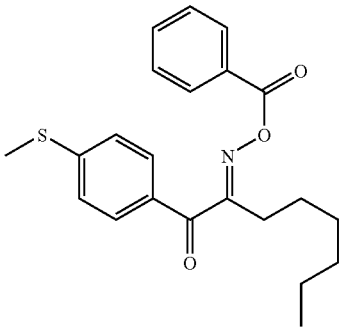

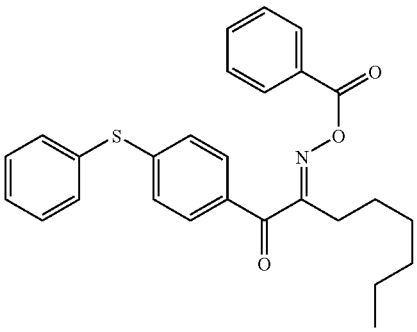

-continued

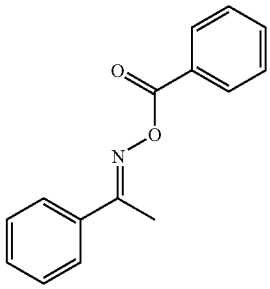

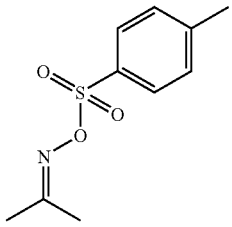

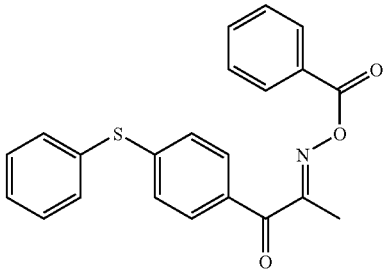

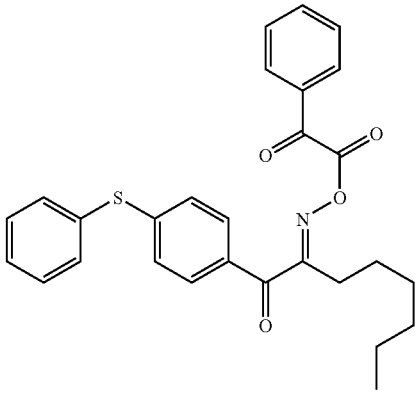

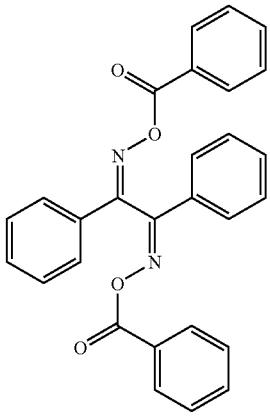

-continued
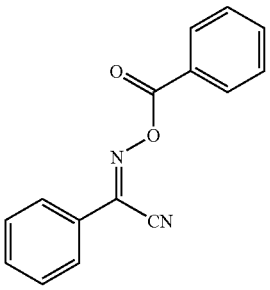
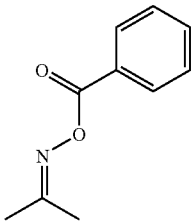
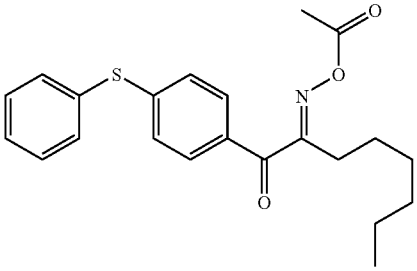
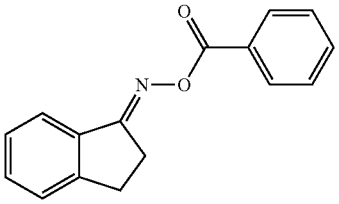
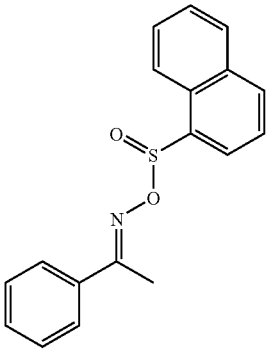
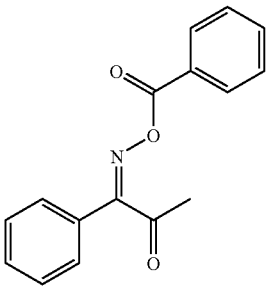
-continued
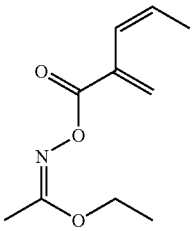
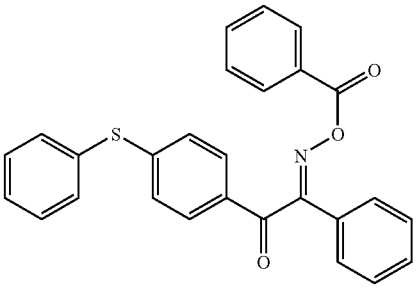
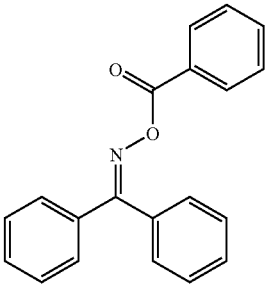
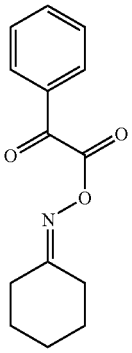
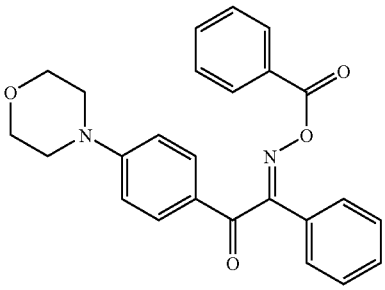

-continued

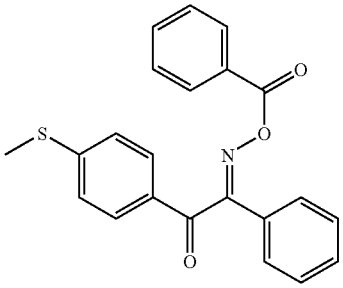

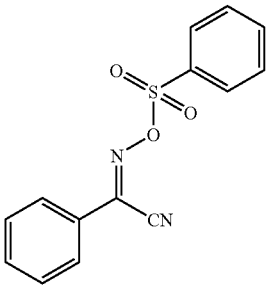

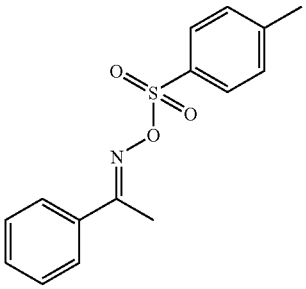

Examples of the onium salts include diazonium salts described in S. I. Schlesinger, Photogr. Sci. Eng. 18, 387 (1974), T. S. Bal et al., Polymer, 21, 423 (1980); ammonium salts described in U.S. Pat. No. 4,069,055 and Japanese Patent Provisional Publication No. 4(1992)-365049; phosphonium salts described in U.S. Pat. Nos. 4,069,055 and 4,069,056; iodonium salts described in European Patent No. 104,143, U.S. Pat. Nos. 339,049 and 410,201, and Japanese Patent Provisional Publication Nos. 2(1990)-150848 and 2(1990)-296514; sulfonium salts described in European Patent Nos. 370,693, 390, 214, 233, 567, 297,443, 297,442, U.S. Pat. Nos. 4,933,377, 161, 811, 410, 201, 339,049, 4,760,013, 4,734,444, 2,833.827, German Patent Nos. 2,904,626, 3,604, 580, 3,604,581; selenonium salts described in J. V. Crivello et al., Macromolecules, 10(6), 1307(1977) and J. V. Crivello et al., J. Polymer Sci., Polymer Chem. Ed., 17, 1047(1979); and arsonium salts described in C. S. Wem et al., The. Proc. Conf. Rad. Curing ASIA, pp. 478, Tokyo, Oct. 1988.

In consideration of reactivity and stability, oxime esters, diazonium salts, iodonium salts and sulfonium salts are preferred. These onium salts serve not as acid-generators but as ionic radical-polymerization initiators in the invention.

The onium salts preferably used in the invention are represented by the following formulas (RI-I) to (RI-III).

(RI-I)

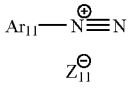

-continued (RI-II)

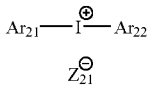

(RI-III)

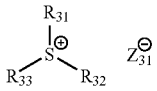

In the formula (RI-I), $Ar_{11}$ is an aryl group having 20 or less carbon atoms that may have 1 to 6 substituent groups. Preferred examples of the substituent groups include an alkyl group having 1 to 12 carbon atoms, an alkenyl group having 2 to 12 carbon atoms, an alkynyl group having 2 to 12 carbon atoms, an aryl group having 6 to 12 carbon atoms, an alkoxy group having 1 to 12 carbon atoms, an aryloxy group having 6 to 12 carbon atoms, a halogen atom, an alkylamino group having 1 to 12 carbon atoms, an dialkylamino group having 2 to 12 carbon atoms, an alkylamido or arylamido group having 2 to 12 carbon atoms, a carbonyl group, carboxyl, cyano, sulfonyl, an alkylthio group having 1 to 12 carbon atoms, and an arylthio group having 6 to 12 carbon atoms. In the formula (RI-I), $Z_{11}^-$ is a monovalent anion. Examples of the anion $Z_{11}^-$ include a halogen ion, perchlorate ion, hexafluorophosphate ion, tetrafluoroborate ion, sulfonate ion, sulfinate ion, thiosulfonate ion and sulfate ion. In consideration of stability, perchlorate ion, hexafluorophosphate ion, tetrafluoroborate ion, sulfonate ion and sulfinate ion are preferred.

In the formula (RI-II), each of $Ar_{21}$ and $Ar_{22}$ is independently an aryl group having 20 or less carbon atoms that may have 1 to 6 substituent groups. Preferred examples of the substituent groups include an alkyl group having 1 to 12 carbon atoms, an alkenyl group having 2 to 12 carbon atoms, an alkynyl group having 2 to 12 carbon atoms, an aryl group having 6 to 12 carbon atoms, an alkoxy group having 1 to 12 carbon atoms, an aryloxy group having 6 to 12 carbon atoms, a halogen atom, an alkylamino group having 1 to 12 carbon atoms, an dialkylamino group having 2 to 12 carbon atoms, an alkylamido or arylamido group having 2 to 12 carbon atoms, a carbonyl group, carboxyl, cyano, sulfonyl, an alkylthio group having 1 to 12 carbon atoms, and an arylthio group having 6 to 12 carbon atoms. In the formula (RI-II), $Z_{21}^-$ is a monovalent anion. Examples of the anion $Z_{21}^-$ include a halogen ion, perchlorate ion, hexafluorophosphate ion, tetrafluoroborate ion, sulfonate ion, sulfinate ion, thiosulfonate ion and sulfate ion. In consideration of stability and reactivity, perchlorate ion, hexafluorophosphate ion, tetrafluoroborate ion, sulfonate ion, sulfinate ion and carboxylic ions are preferred.

In the formula (RI-III), each of $R_{31}$, $R_{32}$ and $R_{32}$ is independently an aryl, alkyl alkenyl or alkynyl group having 20 or less carbon atoms that may have 1 to 6 substituent groups. In consideration of reactivity and stability, they are preferably aryl groups. Preferred examples of the substituent groups include an alkyl group having 1 to 12 carbon atoms, an alkenyl group having 2 to 12 carbon atoms, an alkynyl group having 2 to 12 carbon atoms, an aryl group having 6 to 12 carbon atoms, an alkoxy group having 1 to 12 carbon atoms, an aryloxy group having 6 to 12 carbon atoms, a halogen atom, an alkylamino group having 1 to 12 carbon atoms, an dialkylamino group having 2 to 12 carbon atoms, an alkylamido or arylamido group having 2 to 12 carbon atoms, a carbonyl group, carboxyl, cyano, sulfonyl, an alkylthio group having 1 to 12 carbon atoms, and an arylthio group having 6 to 12 carbon atoms. In the formula (RI-III), $Z_{31}^-$ is a monovalent anion. Examples of the anion $Z_{31}^-$ include a halogen ion, perchlorate ion, hexafluorophosphate ion, tetrafluoroborate ion, sulfonate ion, sulfinate ion, thiosulfonate ion and sulfate ion. In consideration of stability and reactivity, perchlorate ion, hexafluorophosphate ion, tetrafluoroborate ion, sulfonate ion, sulfinate ion and carboxylic ions are preferred. Particularly preferred are carboxylic ions described in Japanese Patent Application No. 2000-160323, and most preferred carboxyl ions are described in Japanese Patent Application Nos. 2001-177150 and 2000-266797.

(N-1)

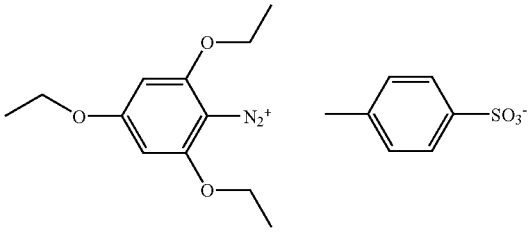

(N-2)

$PF_6^-$ (N-3)

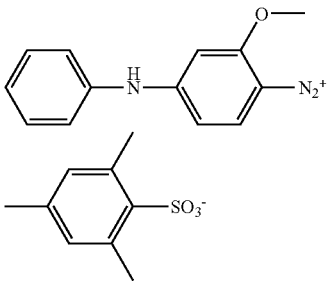

(N-4)

$ClO_4^-$ (N-5)

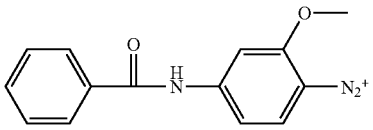

$CF_3SO_3^-$ (N-6)

$BF_4^-$ (N-7)

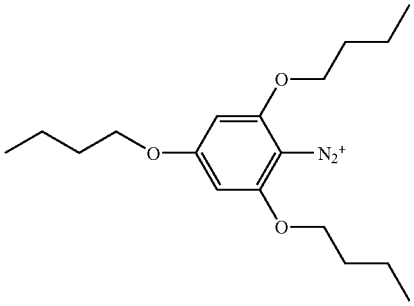

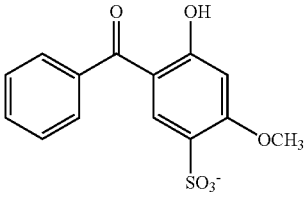

-continued (N-8)

$ClO_4^-$ (N-9)

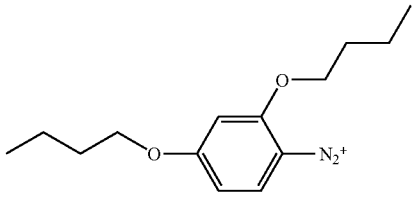

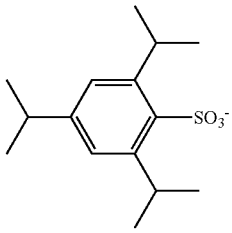

(N-10)

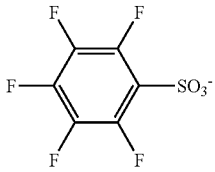

$PF_6^-$ (N-11)

(N-12)

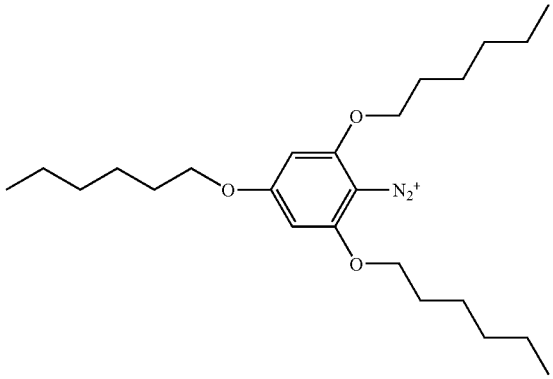

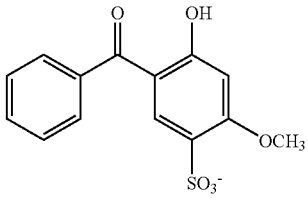

$ClO_4^-$ (N-13)

(N-14)

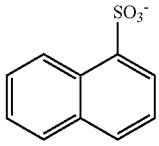

(I-1)

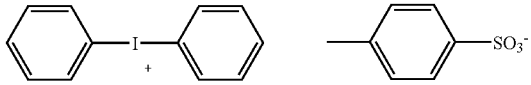

-continued (I-2)

$PF_6^-$ (I-3)

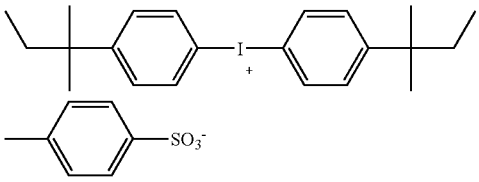

$ClO_4^-$ (I-4)

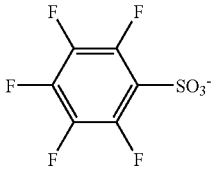

$CF_3SO_3^-$ (I-5)

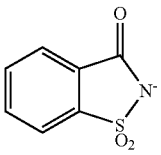

(I-6)

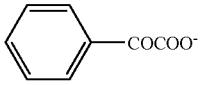

(I-7)

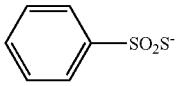

(I-8)

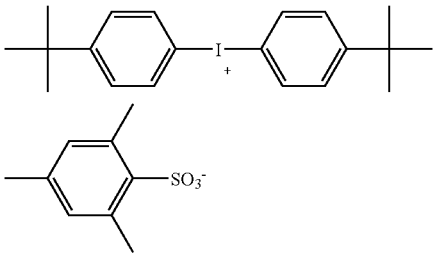

$ClO_4^-$ (I-9)

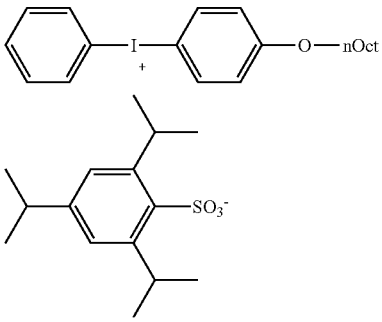

$CF_3COO^-$ (I-10)

$CF_3SO_3^-$ (I-11)

(I-12)

(I-13)

(I-14)

-continued (I-15)

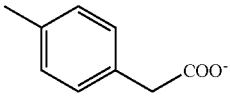

(I-16)

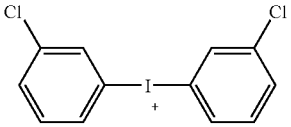

$BF_4^-$ (I-17)

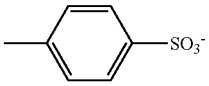

(I-18)

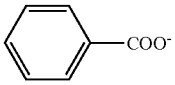

The polymerization initiator is incorporated in the image-recording layer in an amount of preferably 0.1 to 50 wt. %, more preferably 0.5 to 30 wt. %, most preferably 1 to 20 wt. %, based on the total solid content of the image-recording layer. If contained in the above amount, the initiator ensures good sensitivity and prevents the non-imaging area from stain. Two or more polymerization initiators may be used in combination. The polymerization initiator may be contained together with other components in the layer, or otherwise may be separately contained in another layer.

(Ethylenically Unsaturated Polymerizable Compound Having No Adherence to Hydrophilic Support)

The ethylenically unsaturated polymerizable compound having no adherence to hydrophilic support is an addition-polymerizable compound having at least one ethylenically unsaturated double bond. Practically, it is selected from the group of known compounds having at least one, preferably two or more terminal ethylenically unsaturated double bonds. Many compounds of that type are popularly known in the industrial field of the invention, and any of them can be used in the present invention without particular restriction. The compound may be in the form of, for example, monomer, pre-polymer (dimmer, trimer, oligomer), mixture or copolymer thereof. Examples of the compound of monomer or copolymer thereof include unsaturated carboxylic acids (e.g., acrylic acid, methacrylic acid, itaconic acid, crotonic acid, isocrotonic acid, maleic acid), esters or amides thereof. Preferred are, for example, esters derived from unsaturated carboxylic acids and aliphatic polyhydric alcohols; amides derived from unsaturated carboxylic acids and aliphatic polyamines; unsaturated carboxylic esters having nucleophilic substituent groups such as hydroxyl, amino and mercapto; products of additional reactions between amides and mono- or multi-functional isocyanates or epoxys; products of dehydration-condensation reactions between amides and mono- or multi-functional carboxylic acids; products of additional reactions between unsaturated carboxylic acids or amides having electrophilic substituent groups such as isocyanate and epoxy and mono- or multi-functional alcohols, amines or thiols; products of substitution reactions between unsaturated carboxylic acids or amides having eliminating substituent groups such as halogen and tosyloxy and mono- or multifunctional alcohols, amines or thiols. The unsaturated carboxylic acids in the above may be replaced with unsaturated phosphonic acids, styrenes or vinyl ethers.

Examples of the esters in the form of monomer derived from unsaturated carboxylic acids and aliphatic polyhydric alcohols are described below. Examples of the acrylic ester include ethyleneglycol diacrylate, triethyleneglycol diacrylate, 1,3-buranediol diacrylate, tetramethyleneglycol diacrylate, propyleneglycol diacrylate, neopentylglycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri (acryloyloxyethyl) isocyanurate, polyester acrylate oligomer, and isocyanuric acid EO-modified triacrylate.

Examples of the methacrylic ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-buranediol di-methacrylate, hexanediol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)phenyl]dimethylmethane, and bis[p(methacryloxyethoxy)phenyl]dimethylmethane.

Examples of the itaconic ester include ethylene glycol diitaconate, propylene glycol diitaconate, 1,3-buranediol diitaconate, 1,4-buranediol diitaconate, tetramethylene-glycol diitaconate, pentaerythritol diitaconate and sorbitol tetraitaconate. Examples of the crotonic ester include ethylene glycol dicrotonate, tetramethylene glycol dicrotonate, pentaerythritol dicrotonate and sorbitol tetradicrotonate. Examples of the isocrotonic ester include ethylene glycol diisocrotonate, pentaerythritol diisocrotonate and sorbitol tetraisocrotonate. Examples of the maleic ester include ethylene glycol dimalate, triethylene glycol dimalate, pentaerythritol dimalate and sorbitol tetramalate.

In addition, also preferably used are aliphatic alcoholic esters described in Japanese Patent Publication Nos. 46(1971)-27926, 51(1976)-47334 and Japanese Patent Provisional Publication No. 57(1982)-196231; esters of aromatic skeletons described in Japanese Patent Provisional Publication Nos. 59(1984)-5240, 59(1984)-5241 and 2(1990)-226149; and amino-containing esters described in Japanese Patent Publication No. 1(1989)-165613. The above monomers may be mixed to use.

Examples of the amides in the form of monomer derived from unsaturated carboxylic acids and aliphatic polyamines include methylenebisacrylamide, methylenebismethacrylamide, 1,6-hexamethylenebisacrylamide, 1,6-hexamethylenebismethacrylamide, diethylenetriaminetriacrylamide, xylenebisacrylamide, and xylenebismethacrylamide. Also preferred are monomeric amides having cyclohexylene structure described in Japanese Patent Publication No. 54(1979)-21726.

Addition-polymerizable compounds of urethane type obtained by addition reactions of isocyanate and hydroxyl are also preferably used. Examples of the compounds include a vinylurethane compound described in Japanese Patent Publication No. 48(1903)-41708. The disclosed vinylurethane compound has a molecular structure containing two or more polymerizable vinyl groups, and is prepared through the addition reaction of a polyisocyanate compound having two or more isocyanate groups in its molecule with a hydroxyl-containing vinyl monomer represented by the formula (II):

$$CH_2{=}C(R_4)COOCH_2CH(R_5)OH$$

(in which each of $R_4$ and $R_5$ is H or $CH_3$).

Further, yet also preferably used are urethane-acrylates described in Japanese Patent Provisional Publication No. 51(1976)-37193, Japanese Patent Publication Nos. 2(1990)-32293 and 2(1990)-16765; urethane compounds of ethyleneoxide skeletons described in Japanese Patent Publication Nos. 58(1983)-49860, 56(1981)-17654, 62(1987)-39417 and 62(1987)-39418; and addition-polymerizable compounds having amino or sulfide molecular structures described in Japanese Patent Provisional Publication No. 63(1988)-277653, 63(1988)-260909 and 1(1989)-105238. If the amino or sulfide-containing addition-polymerizable compounds are used, photopolymerizable compositions excellent in sensitivity can be prepared.

Sill yet also preferably used are polyesteracrylates described in Japanese Patent Provisional Publication No. 48(1973)-64183, Japanese Patent Publication Nos. 49(1974)-43191 and 52(1977)-30490; multifunctional (meth)acrylate such as epoxyacrylates obtained by reactions of epoxy resins and (meth)acrylic acid; and specific unsaturated compounds described in Japanese Patent Publication Nos. 46(1971)-43946, 1(1989)-40337 and 1(1989)-40336; and vinyl phosphonate compounds described in Japanese Patent Provisional Publication No. 2(1990)-25493. In some cases, perfluoroalkyl group-containing compounds described in Japanese Patent Provisional Publication No. 61(1986)-22048 are preferably used. Photocurable monomers and oligomers described in "Journal of the Adhesion Society of Japan (written in Japanese)", vol. 20 (1984), No. 7, pp. 300 to 308 can be used.

Detailed practical conditions in incorporating the polymerizable compound, for example, what molecular structure the compound should have, whether it is added singly or in combination of two or more and how much it is used are determined according to the aimed presensitized lithographic printing plate. These conditions are selected, for example, from the following viewpoints.

In consideration of sensitivity, the compound preferably has many unsaturated groups in its molecular structure. Two or more functional groups are preferably contained in many cases. In order to reinforce the image-recording layer (hardened layer) remaining in the imaging area, three or more functional groups are preferably contained. Further, it is also preferred to use a combination of compounds having different numbers of functional groups and different polymerizable groups (e.g., combination of acrylic esters, methacrylic esters, styrene compounds and vinyl ether compounds) so as to control both sensitivity and durability.

In determining the polymerizable compound and the amount thereof, it is also necessary to consider the dispersibility and the compatibility with other components (e.g., binder polymer, initiator, colorant) in the image-recording layer. For example, it is sometimes effective in improving the compatibility to use a compound of low purity or two or more compounds in combination. Further, in order to improve adhesion onto the support or another layer such as the overcoating layer described later, a compound having specific structure may be incorporated.

The image-recording layer contains the addition-polymerizable compound in an amount of preferably 5 to 80 wt. %, more preferably 25 to 75 wt. %. The polymerizable compound may be used singly or in combination of two or more.

In adding the polymerizable compound, various conditions such as degree of polymerization inhibitation caused by oxygen, resolution of the resultant image, degree of fogging, refractive change, and adhesion onto the support are also taken into account. According to the conditions, what structure the compound should have, what composition should be prepared and how much the compound should be added are properly determined. Auxiliary layers such as overcoating and undercoating layers may be provided, and desired coating processes may be optionally selected.

(Binder Polymer)

Known binder polymers can be used in the invention without any restriction, but film-formable linear organic polymers are preferred. Examples of the binder polymers include acrylic resins, polyvinyl acetal resins, polyurethane resins, polyurea resins, polyamide resins, polyamide resins, epoxy resins, methacrylic resins, polystyrene resin, novolac phenol resins, polyester resins, synthetic rubbers and natural rubbers.

The binder polymer is preferably cross-linkable to improve the film-strength of layer in the imaging area. In order to make the binder polymer cross-linkable, cross-linkable functional groups such as ethylenically unsaturated bonds may be introduced into the main or side chain of the polymer. The cross-linkable functional groups may be introduced through copolymerization reaction.

Examples of the polymer having an ethylenically unsaturated bond in the main chain include poly-1,4-butadiene and poly-1,4-isoprene.

Examples of the polymer having an ethylenically unsaturated bond in the side chain include a polymer of (meth)acrylic ester or amide whose residue (namely, R in —COOR or —CONHR, respectively) has an ethylenically unsaturated bond.

Examples of the residue (R in the above) having an ethylenically unsaturated bond include $—(CH_2)_n—CR^1{=}CR^2R^3$, $—(CH_2O)_nCH_2CR^1{=}CR^2R^3$, $—(CH_2CH_2O)_nCH_2CR^1—CR^2R^3$, $—(CH_2)_nNH—CO—O—CR^1{=}CR^2R^3$, $—(CH_2)_n—O—CO—CR^1{=}CR^2R^3$ and $—(CH_2CH_2O)_2—X$ (in which each of $R^1$ to $R^3$ is a hydrogen atom, a halogen atom or an alkyl, aryl, alkoxy or aryloxy group having 1 to 20 carbon atoms, provided that $R^1$ and $R^2$, or $R^1$ and $R^3$ may be combined to form a ring; n is an integer of 1 to 10; and X is cyclopentadienyl residue).

Examples of the residue of ester include $—CH_2CH{=}CH_2$ (described in Japanese Patent Publication No. 7(1995)-21633), $—CH_2CH_2O—CH_2CH{=}CH_2$, $—CH_2C(CH_3){=}CH_2$, $—CH_2CH{=}CH—C_6H_5$, $—CH_2CH_2OCOCH{=}CH—C_6H_5$, $—CH_2CH_2—NH-COO—CH_2CH{=}CH_2$ and $—CH_2CH_2O—X$ (in which X is cyclopentadienyl residue).

Examples of the residue of amide include $—CH_2CH{=}CH_2$, $—CH_2CH_2—Y$ (in which Y is cyclohexene residue) and $—CH_2CH_2—OCO—CH{=}CH_2$.

The cross-linkable binder polymer is hardened, for example, in the following way. Free radicals (initiation radicals or propagation radicals generated by the polymerizable compound in polymerization process) are attached onto the cross-linkable functional groups, which are polymerized directly or through chain-polymerization to cross-link the polymer molecules; or otherwise an atom (for example, an atom neighboring the cross-linkable group) is extracted by the free radical to generate polymer radicals, which are combined to cross-link the polymer molecules.

The amount of cross-linkable groups (amount of unsaturated double bond capable of radical polymerization, which can be determined by iodometric titration) in the binder polymer is preferably in the range of 0.1 to 10.0 mmol, more preferably in the range of 1.0 to 7.0 mmol, most preferably in the range of 2.0 to 5.5 mmol based on 1 g of the binder polymer. If containing the groups in an amount of the above range, the resultant presensitized plate has good sensitivity and satisfying shelf life.

The binder polymer preferably has such good solubility or dispersibility in ink and/or dampening water that the image-recording layer in the unexposed areas can be well removed in press development.

In consideration of the solubility or dispersibility in ink, the binder polymer is preferably oleophilic. In consideration of the solubility or dispersibility in dampening water, the binder polymer is preferably hydrophilic. In the invention, therefore, a hydrophobic binder polymer and a hydrophilic one may be used in combination.

Examples of the hydrophilic binder polymer include polymers having hydrophilic groups such as hydroxyl, carboxyl, carboxylate, hydroxyethyl, polyoxyethyl, hydroxypropyl, polyoxypropyl, amino, aminoethyl, aminopropyl, ammonium, amido, carboxymethyl, sulfonic group and phosphoric group.

Concrete examples of the hydrophilic binder polymer include gum arabic, casein, gelatin, starch derivatives, carboxymethylcellulose and sodium salt thereof, cellulose acetate, sodium alginate, vinyl acetate-maleic acid copolymer, styrene-maleic acid copolymer, polyacrylic acid and salts thereof, polymethacrylic acid and salts thereof, homopolymer or copolymers of hydroxyethyl methacrylate, homopolymer or copolymers of hydroxyethyl acrylate, homopolymer or copolymers of hydroxypropyl methacrylate, homopolymer or copolymers of hydroxypropyl acrylate, homopolymer or copolymers of hydroxybutyl methacrylate, homopolymer or copolymers of hydroxybutyl acrylate, polyethylene glycols, hydroxypropylene polymers, polyvinyl alcohols, hydrolyzed polyvinyl acetate having a hydrolytic degree of 60 wt. % or more (preferably 80 wt. % or more), polyvinyl formal, polyvinyl butyral, polyvinyl pyrrolidone, homopolymer or copolymers of acrylic amide, homopolymer or copolymers of methacrylic amide, homopolymer or copolymers of N-methylolacrylamide, alcohol-soluble nylon, and polyether of epichlorohydrin and 2,2-bis-(4-hydroxyphenyl)-propane.

The binder polymer has a weight average molecular weight of preferably 5,000 or more, more preferably 10,000 to 300,000, and also has a number average molecular weight of preferably 1,000 or more, more preferably 2,000 to 250,000. The polydispersity coefficient (weight average molecular weight/number average molecular weight) is preferably in the range of 1.1 to 10.

The binder polymer may be a random polymer, a block polymer or a graft polymer, but is preferably a random polymer.

The binder polymer can be synthesized in a known manner. Example of the solvent in synthesizing the polymer include tetrahydrofuran, ethylene dichloride, cyclohexanone, methyl ethyl ketone, acetone, methanol, ethanol, ethylene glycol, monomethyl ether, ethylene glycol monoethyl ether, 2-methoxyethylacetate, diethylene glycol dimethyl ether, 1-methoxy-2-propanol, 1-methoxy-2-propyl acetate, N,N-dimethylformamide, N,N-dimethylacetamide, toluene, ethyl acetate, methyl lactate, ethyl lactate, dimethylsulfoxide, and water. These may be used singly or in combination of two or more.

The radical polymerization initiator in preparing the binder polymer may be a known compound such as an azo initiator or a peroxide initiator.

The binder polymer may be used singly or in a mixture of two or more.

The image-recording layer contains the binder polymer in an amount of 5 to 90 wt. %, preferably 10 to 80 wt. %, more preferably 30 to 70 wt. % based on the total solid content of the layer. The binder polymer in the above amount ensures both durability and image-formability of the layer in the imaging area.

The ratio by weight of the polymerizable compound to the binder polymer is preferably in the range of 1/9 to 7/3.

In the invention, the aforementioned and later-described components may be in various forms when incorporated in the image-recording layer. For example, as described in Japanese Patent Provisional Publication No. 2002-287334, they are dissolved in an appropriate solvent to prepare a coating solution, which is then spread to form an image-recording layer of molecular dispersion type. Otherwise, as described in Japanese Patent Provisional Publication Nos. 2001-277740 and 2001-277742, all or a part of them are encased in microcapsules, which are contained in the layer to form an image-recording layer of microcapsule type. In the image-recording layer of microcapsule type, some components may be incorporated out of the microcapsules. The image-recording layer of microcapsule type is suitable for press development.

The layer of microcapsule type can be formed in known manners. For example, the microcapsules can be prepared by coacervation described in U.S. Pat. Nos. 2,800,457 and 2,800,458; by surface-polymerization U.S. Pat. No. 3,287,154, Japanese Patent Publication Nos. 38(1963)-19574 and 42(1967)-446; by polymer precipitation described in U.S. Pat. Nos. 3,418,250 and 3,660,304; by the process described in U.S. Pat. No. 3,796,669 in which walls of the microcapsules are made of isocyanatopolyol; by the process described in U.S. Pat. No. 3,914,511 in which walls of the microcapsules are made of isocyanate; by the process described in U.S. Pat. Nos. 4,001,140, 4,087,376 and 4,089,802 in which walls of the microcapsules are made of urea-formaldehyde or urea-formaldehyde-resorcinol; by the process described in U.S. Pat. No. 4,025,445 in which walls of the microcapsules are made of melamine-formaldehyde resin or hydroxycellulose; by the in-situ process of monomer polymerization described in Japanese Patent Publication Nos. 36(1961)-9163 and 51(1976)-9079; by the spray-drying process described in British Patent No. 930,422 and U.S. Pat. No. 3,111,407; or by the electrolytic dispersive cooling process described in British Patents No. 952,807 and 967,074. The process for preparing the microcapsules is not restricted to the above.

In the invention, the microcapsules preferably have walls made of three-dimensionally cross-linked resin capable of being swollen with the solvent. From this viewpoint, the walls are made of preferably polyurea, polyurethane, polyester, polycarbonate, polyamide or a mixture thereof, more preferably polyurea or polyurethane. The compound having the above-described cross-linkable group such as ethylenically unsaturated bond, which may be introduced into the binder polymer, may be contained in the walls.

The microcapsules have a mean size of preferably 0.01 to 3.0 μm, more preferably 0.05 to 2.0 μm, and most preferably 0.10 to 1.0 μm. If so, the resultant presensitized plate gives an image with good resolution and stably keeps its quality even as time elapses.

(Surface Active Agent)

In the invention, the image-recording layer preferably contains a surface active agent so that the press development may be performed well and that the surface may receive liquid well. The surface active agent may be a nonionic agent, an anionic one, a cationic one, an amphoteric one or a fluorine-containing one. The surface active agent may be used singly or in combination of two or more.

There is no particular restriction on the nonionic surface active agent, and known agents can be used. Examples of the nonionic surface active agents include polyoxyethylene alkyl ether, polyoxyethylene alkylphenyl ether, polyoxyethylene polystrylphenyl ether, polyoxyethylene polyoxypropylene-alkyl ether, partial esters of glycerol-fatty acids, partial esters of sorbitan-fatty acids, partial esters of pentaerythritol-fatty acids, esters of propyleneglycerol with monofatty acids, partial esters of sucrose-fatty acids, partial esters of polyoxyethylene-sorbitan-fatty acids, partial esters of polyoxyethylene-sorbitol-fatty acids, esters of polyethylene glycerol with monofatty acid, partial esters of polyglycerol with fatty acid, polyethylenized caster oils, partial esters of polyoxyethylene glycerol with fatty acids, diethanol amides of fatty acids, N,N-bis-2-hydroxyalkyl amines, polyoxyethylenealkylamine, fatty acids esters of triethanolamine, trialkylamineoxide, polyethylene glycol, and copolymer of polyethylene glycol and polypropylene glycol.

There is no particular restriction on the anionic surface active agent, and known agents can be used. Examples of the anionic surface active agent include salts of fatty acids, salts of abietic acid, salts of hydroxyalkanesulfonic acid, salts of alkanesulfonic acid, salts of dialkylsufosuccinic ester, salts of straight-alkylbenzenesulfonic acid, salts of branched-alkylbenzenesulfonic acid, salts of alkylnaphthalenesulfonic acid, salts of alkylphenoxypolyoxyethylenepropyl with sulfonic acid, salts of polyoxyethylenealkylsulfophenyl ether, sodium salt of N-methyl-N-oleyltaurine, disodium salt of N-alkylsufosuccinic mono-amide, salts of petroleum sulfonic acid, sulfonated tallow oil, sulfate ester salts of fatty acid alkyl esters, ester salts of alkylsulfate, salts of polyoxyethylenealkylether sulfate ester, salts of fatty acid monoglycerol sulfate, salts of polyoxyethylenealkylphenyl ether sulfate, salts of polyoxyethylenestyrylphenyl ether sulfate, salts of alkyl-phosphate ester, salts of polyoxyethylenealkylether phosphate ester, salts of polyoxyethylenealkylphenylether phosphate ester, partially saponified copolymer of styrene/maleic anhydride, saponified copolymer of olefin/maleic anhydride, and condensed naphthalenesufonate-formalin.

There is no particular restriction on the cationic surface active agent, and known agents can be used. Examples of the cationic surface active agent include salts of alkyl amines, salts of tertiary ammoniums, salts of polyoxyethylenealkyl amines, and polyethylenepolyamine derivatives.

There is no particular restriction on the amphoteric surface active agent, and known agents can be used. Examples of the amphoteric surface active agent include carboxybetaines, aminocarboxylic acids, sulfobetaines, aminosulfates, and imidazolines.

In the above, "polyoxyethylene" can be replaced with "polyoxyalkylene" such as polyoxymethylene, polyoxypropylene and polyoxybutylene. The thus-replaced surface active agents are also usable in the invention.

Particularly preferred is a fluorine-containing surface active agent having a perfluoroalkyl group. Examples of the fluorine-containing surface active agent include anionic agents such as salts of perfluoroalkyl carboxylic acids, salts of perfluoroalkyl sulfonic acids, perfluoroalkyl phosphates; amphoteric agents such as perfluoroalkyl betaine; cationic agents such as perfluoroalkyltrimethyl ammonium; and nonionic agents such as perfluoroalkylamine oxide, perfluoroalkylethylene oxide adduct, oligomer having a perfluoroalkyl group and a hydrophilic group; oligomer having a perfluoroalkyl group and an hydrophobic group; and urethane having a perfluoroalkyl group and an hydrophobic group. Further, fluorine-containing surface active agents described in Japanese Patent Publication Nos. 62(1987)-170950, 62(1987)-226143 and 60(1985)-168144 are also preferably usable.

The surface active agent may be used singly or in combination of two or more.

The image-recording layer contains the surface active agent in an amount of preferably 0.001 to 10 wt. %, more preferably 0.01 to 5 wt. % based on the total solid content of the layer.

(Colorant)

The image-recording layer of the invention may contain various compounds other than the above. For example, a dye absorbing visible light considerably may be incorporated as a colorant of the image. Examples of the colorant include Oil Yellow #101, Oil Yellow #103, Oil Pink #312, Oil Green BG, Oil Blue. BOS, Oil Blue #603, Oil Black BY, Oil Black BS and Oil Black T-505 (from Orient Chemical Industries Co., Ltd); Victoria Pure Blue, Crystal Violet (CI42555), Methyl Violet (CI42535), Ethyl Violet, Rhodamine B (CI145170B), Malachite Green (CI42000) and Methylene Blue (CI52015); and dyes described in Japanese Patent Provisional Publication No. 62(1987)-293247. Further, phthalocyanine dyes, azo dyes, carbon black and titanium oxide can be also preferably used.

The amount of the colorant is preferably in the range of 0.01 to 10 wt. % based on the total solid content of the image-recording layer.

(Print-Out Agent)

The image-recording layer of the invention may contain a compound for forming images by printing-out. The compound is discolored with acids or radicals. As the compound for printing-out, various dyes such as diphenylmethane dyes, triphenylmethane dyes, thiazine dyes, oxazine dyes, xanthene dyes, anthraquinone dyes, iminoquinone dyes, azoquinone dyes and azomethine dyes are preferably used.

Examples of the compound include Brilliant Green, Ethyl Violet, Methyl Green, Crystal violet, Basic Fuchsine, Methyl Violet 2B, Quinaldine Red, Rose Bengal, methanyl Yellow, Thymol Sulfonphthalein, Xylenol Blue, Methyl Orange, Paramethyl Red, Congo Red, Benzo Purpurin 4B, α-Naphthyl Red, Nile Blue 2B, Nile Blue A, Methyl Violet, Malachite Green, Parafuchsine, Victoria Pure Blue BOH (from Hodogaya Chemical Co., Ltd), Oil Blue #603 (from Orient Chemical Industries Co., Ltd), Oil Pink #312 (from Orient Chemical Industries Co., Ltd), Oil Red 5B (from Orient Chemical Industries Co., Ltd), Oil Scarlet #308 (from Orient Chemical Industries Co., Ltd), Oil Red OG (from Orient Chemical Industries Co., Ltd), Oil Red RR (from Orient Chemical Industries Co., Ltd), Oil Green #502 (from Orient Chemical Industries Co., Ltd), Spiron Red BEH Special (from Hodogaya Chemical Co., Ltd), m-Cresol Purple, Cresol Red, Rhodamine B, Rhodamine 6G, Sulfo-rhodamine B, auramine, 4-pdiethylaminophenyliminonaphthoquinone, 2-carboxyanilino-4-p-diethylaminophenyl-iminonaphthoquinone, 2-carboxystearylamino-4-p-N,N-bis(hydroxyethyl)aminophenyliminonaphthoquinone, 1-phenyl-3-methyl-4-p-diethylaminophenyl-imino-5-pyrazolone, 1-β-naphthyl-4-p-diethylaminophenyl-imino-5-pyrazolone, and Leuco dyes such as p,p',p"-hexamethyltriaminotriphenylmethane (Leuco Crystal Violet) and Pergascript Blue SRB (from Ciba-Geigy).

In addition, Leuco dyes conventionally known as materials of thermal paper or pressure-sensitive paper can be preferably used. Examples of them include Leuco Crystal Violet Lactone, Malachite Green Lactone, Benzoyl Leuco methylene Blue, 2-(N-phenyl-N-methylamino)-6-(N-p-tolyl-N-ethyl)amino-fluoran, 2-anilino-3-methyl-(N,N-diethylamino)-5-methyl-7-(N,N-dibenzylamino)-fluoran, 3-(N-cyclohexyl-N-methylamino)-6-methyl-7-anilinofluoran, 3-(N,N-diethyl-amino)-6-methyl-7-anilinofluoran, 3-(N,N-diethylamino)-6-methyl-7-xylidinofluoran, 3-(N,N-diethylamino)-6-methyl-7-chlorofluoran, 3-(N,N-diethylamino)-6-methoxy-7-aminofluoran, 3-(N,N-diethylamino)-7-(4-chloroanilino)fluoran, 3-(N,N-diethylamino)-7-chlorofluoran, 3-(N,N-diethylamino)-7-benzylaminofluoran, 3-(N,N-diethylamino)-7,8-benzofluoran, 3-(N,N-dibutylamino)-6-methyl-7-anilinofluoran, 3,3-bis(1-ethyl-2-methylindole-3-yl)phthalide, 3,3-bis(1-n-butyl-2-methylindole-3-yl)phthalide, 3,3-bis(p-dimethylaminophenyl)-6-dimethylaminophthalide, 3-(4-diethylamino-2-ethoxyphenyl)-3-(1-ethyl-2-methylindole-3-yl)-4-azaphthalide, and 3-(4-diethylaminophenyl)-3-(1-ethyl-2-methylindole-3-yl)phthalide.

The amount of the compound discolored with acids or radicals is preferably in an amount of 0.01 to 10 wt. % based on the total solid content of the layer.

(Polymerization Inhibitor)

The image-recording layer of the invention may contain a small amount of thermal polymerization inhibitor for inhibiting unfavorable thermal polymerization while the presensitized plate is produced or stored.

Examples of the thermal polymerization inhibitor include hydroquinone, p-methoxyphenol di-t-butyl-p-cresol, pyrogallol, t-butyl catechol, benzoquinone, 4,4'-thiobis(3-methyl-6-t-butylphenol), 2,2'-methylenebis(4-methyl-6-t-butylphenol), and n-nitroso-N-phenylhydroxylamine aluminum salt.

The amount of the thermal polymerization inhibitor is preferably in an amount of approx. 0.01 to approx. 5 wt. % based on the total solid content of the image-recording layer.

(Higher Fatty Acid Derivative)

The image-recording layer of the invention may contain a higher fatty acid such as behenic acid or a derivative thereof, so as to prevent oxygen in air from inhibiting the polymerization. In forming the image-recording layer, a coating solution containing the higher fatty acid or derivative thereof is spread and then dried in a way that the higher fatty acid or derivative thereof may be thickly contained near the surface of the layer. The amount of the higher fatty acid or derivative thereof is preferably in an amount of approx. 0.1 to approx. 10 wt. % based on the total solid content of the image-recording layer.

(Plasticizer)

The image-recording layer of the invention may contain a plasticizer so that the press development may be performed well. Examples of the plasticizer include phthalic esters such as dimethyl phthalate, diethyl phthalate, dibutyl phthalate, diisobutyl phthalate, dioctyl phthalate, octylcapryl phthalate, dicyclohexyl phthalate, ditridecyl phthalate, butylbenzyl phthalate, diisodecyl phthalate and diallyl phthalate; glycolic esters such as dimethylglycol phthalate, ethylphthalylethyl glycolate, methylphthalylethyl glycolate, butylphthalylbutyl glycolate and triethyleneglycoldicaprylic esters; phosphoric esters such as tricresyl phosphate and triphenyl phosphate; aliphatic dibasic acid-derived esters such as diisobutyl adipate, dioctyl adipate, dimethyl sebacate, dibutyl sebacate, dioctyl azelate and dibutyl maleate; and other esters such as polyglycidyl methacrylate, triethyl citrate, glycerin triacetyl ester and butyl laurate.

The amount of the plasticizer is preferably in an amount of approx. 30 wt. % or less based on the total solid content of the image-recording layer.

(Inorganic Fine Particles)

The image-recording layer of the invention may contain inorganic fine particles so that the hardened layer in the imaging area may have enough strength and so that the layer in the non-imaging area may be well removed in the press development.

The inorganic fine particles are, for example, made of silica, alumina, magnesium oxide, titanium dioxide, magnesium carbonate, calcium alginate or a combination thereof. Even if the particles cannot covert light to heat, they can reinforce the layer or roughen the surface of the layer to enhance the adhesion to the support or other layers.

The inorganic fine particles have a mean particle size of preferably 5 nm to 10 μm, more preferably 0.5 μm to 3 μm. If having the mean size in the above range, the particles are so stably dispersed in the image-recording layer that the layer has enough film-strength and that the layer in the non-imaging area is enough hydrophilic to avoid stain in printing.

As the inorganic fine particles, commercially available colloidal silica dispersions are usable.

The amount of the inorganic fine particles is preferably in an amount of approx. 20 wt. % or less, more preferably in an amount of approx. 10 wt. % or less based on the total solid content of the image-recording layer.

(Low Molecular-Weight Hydrophilic Compound)

The image-recording layer of the invention may contain a low molecular-weight hydrophilic compound so that the press development may be performed well. Examples of the low molecular-weight hydrophilic compound include water-soluble organic compounds such as glycols, ethers and ester derivatives thereof (e.g., ethylene glycol, diethylene glycol, triethylene glycol, propylene glycol, dipropylene glycol, tripropylene glycol); polyhydroxy compounds (e.g., glycerin and pentaerythritol); organic amines and salts thereof (e.g., triethanolamine, diethanolamine, mono-ethanolamine); organic sulfonic acids and salts thereof (e.g., toluenesulfonic acid, benzenesulfonic acid); organic phosphoric acids and salts thereof (e.g., phenylphosphoric acid); and organic carboxylic acids and salts thereof (e.g., tartaric acid, oxalic acid, citric acid, malic acid, lactic acid, gluconic acid and amino acids).

(Formation of Image-Recording Layer)

The image-recording layer can be formed by dissolving or dispersing the above-described components in a solvent to prepare a coating solution, which is then spread to coat a support. Examples of the solvent include ethylene dichloride, cyclohexane, methyl ethyl ketone, methanol, ethanol, propanol, ethyleneglycol monomethyl ether, 1-methoxy-2-propanol, 2-methoxyethyl acetate, 1-methoxy-2-propylacetate, dimethoxyethane, methyl lactate, ethyl lactate, N,N-dimethylacetamide, N,N-dimethylformamide, tetramethylurea, N-methylpyrrolidone, dimethyl sulfoxide, sulfolane, γ-butyllactone, toluene and water. These, however, by no means restrict the invention. The solvents may be used singly or in a mixture of two or more. The solid content in the coating solution is preferably in the range of 1 to 50 wt. %.

Two or more coating solutions in which the same or different components selected from the above are dissolved or dispersed in the same or different solvents may be prepared, and repeatedly spread and dried to form the image-recording layer.

How much the formed image-recording layer after dried should contain the solid content is determined according to the usage of the resultant presensitized plate, but is generally in the range of 0.3 to 3.0 g/m$^2$. If so, the formed image-forming layer is excellent in both sensitivity and film-properties.

The coating solution can be spread to coat with various means such as bar-coater, whirler, spray coater, curtain flow coater, dip coater, air knife coater, blade coater, and roll coater.

(Support)

There is no particular restriction on the support used in the presensitized lithographic printing plate of the invention, as long as the support has good dimensional stability in the form of a plate. Examples of the support-include sheets, films or plates of paper, paper laminated with plastics (e.g., polyethylene, polypropylene, polystyrene), metals (e.g., aluminum, zinc, copper), plastics (e.g., cellulose diacetate, cellulose triacetate, cellulose propionate, cellulose acetate lactate, cellulose nitrate, polyethylene terephthalate, polyethylene, polystyrene, polypropylene, polycarbonate, polyvinylacetal). Also usable are sheets of paper or plastic films on which the above metals are laminated or deposited. Preferred are a polyester film and an aluminum plate. Since stable in dimension and available at low cost, an aluminum plate is particularly preferred.

The aluminum plate is a plate of pure aluminum, an alloy plate comprising the main component of aluminum and a small amount of other metals, or a film of aluminum or alloy thereof laminated with plastics. Examples of the metals other than aluminum in the alloy include Si, Fe, Mn, Cu, Mg, Cr, Zn, Bi, Ni and Ti. In the invention, a plate of pure aluminum is preferred. However, it is difficult in refinement to obtain completely pure aluminum, and hence other metals may be contained slightly. The components of aluminum plate are not restricted, and known aluminum plates can be optionally used.

The support has a thickness of preferably 0.1 to 0.6 mm, more preferably 0.15 to 0.4 mm, most preferably 0.2 to 0.3 mm.

The surface of the aluminum plate is preferably beforehand subjected to surface treatments such as roughing treatment and anodic oxidation treatment, so as to ensure hydrophilicity and to improve adhesion between the image-recording layer and the support. Before subjected to roughing treatment, the surface may be subjected to oil-removing treatment to remove the rolling oil with surface active agent, organic solvent or alkaline aqueous solution, if desired.

The roughing treatment can be mechanical treatment, electrochemical treatment (in which the surface is electrochemically dissolved partly) or chemical treatment (in which the surface is chemically dissolved partly).

Examples of the mechanical roughing treatment include ball grinding, brush grinding, blast grinding and buff grinding. The electrochemical roughing treatment is, for example, a procedure in which direct or alternating current is applied to the plate in an electrolysis solution containing acid such as hydrochloric acid or nitric acid. The electrolytic roughing in a mixed acid (described in Japanese Patent Provisional Publication No. 54(1979)-63902) may be carried out.

After the roughing treatment, the aluminum plate may be subjected to alkali etching treatment, if needed. As the alkali etching liquid, an aqueous solution of potassium hydroxide or sodium hydroxide is generally used. After the alkali etching treatment, a neutralizing treatment is preferably carried out. The neutralized aluminum plate is further subjected to anodic oxidation treatment, if desired, so as to improve the abrasion resistance of the support.

Various electrolytes forming a porous oxide film can be used in the anodic oxidation treatment. Examples of the electrolyte include sulfuric acid, hydrochloric acid, oxalic acid, chromic acid, and mixtures thereof. The concentration is optionally determined according to the used electrolyte.

The conditions of the anodic oxidation treatment depend on the used electrolyte, and hence are not determined indiscriminately. Normally, however, the anodic oxidation treatment can be carried out under the following conditions: the concentration of the electrolytic solution is in the range of 1 to 80 wt. %, the temperature of the solution is in the range of 5 to 70° C., the electric current density is in the range of 5 to 60 A/dm$^2$, the voltage is in the range of 1 to 100 V and the time for electrolysis is in the range of 10 seconds to 5 minutes. The oxide film formed by the anodic oxidation has a thickness of preferably 1.0 to 5.0 g/m$^2$, more preferably 1.5 to 4.0 g/m$^2$. If the above conditions are satisfied, the support surface bared in the non-imaging area has good abrasion resistance and the resultant printing plate is improved in plate wear.

The plate thus subjected to the surface treatment and covered with the anodic oxide film may be immediately used as the support of the invention, but may be further optionally subjected to other treatments for improving the adhesion to the layer provided thereon, for enhancing the hydrophilicity, for protecting from stain and for insulating from heat. Examples of the additional treatments include treatments described in Japanese Patent Provisional Publication Nos. 2001-253181 and 2001-322365 in which micropores of the anodic oxide film are enlarged or covered, and surface-hydrophilizing treatment in which the plate is immersed in an aqueous solution containing a hydrophilic compound.

Examples of the surface-hydrophilizing treatment include alkali metal silicate treatment described in U.S. Pat. Publication Nos. 2,714,066, 3,181,461, 3,280,734 and 3,902,734 in which the plate is immersed or electrolyzed in an aqueous solution of, for example, sodium silicate; treatment with potassium fluorinated zirconate described in Japanese Patent Publication No. 36(1961)-22063; and treatment with polyvinylsulonic acid described in U.S. Pat. Publication Nos. 3,276,868, 4,153,461 and 4,689,272.

In the case where an insufficiently hydrophilic film such as a polyester film is used as the support, a hydrophilic layer is preferably provided by coating procedure to hydrophilize the surface. The hydrophilic layer is preferably a layer formed from a coating solution (disclosed in Japanese Patent Provisional Publication No. 2001-199175) containing colloidal oxide or hydroxide of an element selected from the group consisting of Be, Mg, Al, Si, Ti, B, Ge, Sn, Zr, Fe, V and Sb; a layer containing organic hydrophilic matrix (disclosed in Japanese Patent Provisional Publication No. 2002-79772) made of cross-linked or pseudo-cross-linked organic hydrophilic polymer; a layer containing inorganic hydrophilic matrix obtained by sol-gel-conversion comprising hydrolysis and condensation reaction of polyalkoxysilane, titanate, zirconate or aluminate; or an inorganic thin film layer containing metal oxide on its surface. Particularly preferred is a hydrophilic layer formed from a coating solution containing colloidal oxide or hydroxide of silicon.

Further, in the case where a polyester film is used as the support, an anti-static layer is preferably formed on both or either of the support surfaces on the hydrophilic layer-side and the opposite side. If provided between the support and the hydrophilic layer, the anti-static layer improves the adhesion between them. The anti-static layer is, for example, a polymer layer (disclosed in Japanese Patent Provisional Publication No. 2002-79772) containing dispersed fine particles of metal oxide or matting agent.

The thus-prepared support preferably had a central surface roughness of 0.10 to 1.2 μm. If having a roughness in that range, the support is excellent in adhesion to the image-recording layer, in plate wear and in resistance to stain.

The support preferably has a color density of 0.15 to 0.65 in term of reflection density. If having a color density in that range, the support enough prevents halation in exposure to form a good image.

(Back-Coating Layer)

After the support is subjected to surface treatment or an undercoating layer is provided, a back-coating layer may be provided on the back (bottom) surface of the support, if needed.

The back-coating layer is, for example, made of organic polymer described in Japanese Patent Provisional Publication No. 5(1993)-45885 or metal oxides obtained by hydrolysis and condensation polymerization of organic or inorganic metal compounds described in Japanese Patent Provisional Publication No. 6(1994)-35174. Since easily available at low cost, alkoxy compounds of silicon such as $Si(OCH_3)_4$, $Si(OC_2H_5)_4$, $Si(OC_3H_7)_4$ and $Si(OC_4H_9)_4$ are preferably used.

(Undercoating Layer)

In the presensitized lithographic printing plate of the invention, an undercoating layer may be provided between the support and the image-recording layer. The under-coating layer serves as a thermo-insulating layer, which prevents heat generated by exposure of an IR laser beam from diffusing to the support and hence which makes the heat enough efficiently used to improve the sensitivity. On the other hand, the undercoating layer makes the image-recording layer in the unexposed areas so easily peeled from the support that the press development is well performed.

The undercoating layer preferably contains silane-coupling agent having addition-polymerizable ethylenically unsaturated double bond-containing reactive groups (described in Japanese Patent Provisional Publication No. 10(1998)-282679) or phosphor compound having ethylenically unsaturated double bond-containing reactive groups.

The coating amount (solid content) of the under-coating layer is preferably in the range of 0.1 to 100 mg/m$^2$, more preferably in the range of 3 to 30 mg/m$^2$.

(Protective Layer)

In the presensitized lithographic printing plate of the invention, a protective layer may be provided on the image-recording layer for protecting the layer from scratches, from oxygen and from abrasions when exposed to laser beams of high luminance.

In the lithographic printing process of the invention, the presensitized plate is normally exposed to light in air. During the exposure, oxygen in air often inhibits the image-forming reaction, and at the same time the image-recording layer is often contaminated with low molecular weight-compounds such as basic substances. The protective layer is expected to prevent the oxygen and the compounds in air from inhibiting the image-forming reaction, and accordingly is preferably poorly permeable to the low molecular weight-substances such as oxygen, highly transparent to light for exposure, excellent in adhesion to the image-recording layer, and easily removable in the press development after the exposure. The protective layer having these characteristics has been studied, and is disclosed in, for example, U.S. Pat. Publication No. 3,458,311 and Japanese Patent Provisional Publication No. 55(1980)-49729.

The protective layer can be prepared from, for example, water-soluble polymers relatively excellent in crystallization. Examples of the polymer include water-soluble polymers such as polyvinyl alcohol, polyvinyl pyrrolidone, acidic celluloses, gum Arabic, and polyacrylic acid. If prepared from polyvinyl alcohol (PVA), the formed protective layer is excellent in protection from oxygen and in removal in the development. The polyvinyl alcohol may be partly substituted with ester, ether or acetal as long as still having enough non-substituted polyvinyl units to form a water-soluble protective layer and to make the layer protect the image-recording layer from oxygen. Polyvinyl alcohol hydrolyzed in a degree of 71 to 100% and having a polymerization degree of 300 to 2,400 is preferably used. Examples of the polyvinyl alcohol include products of Kuraray Co., Ltd. such as PVA-105, PVA-110, PVA-117, PVA-117H, PVA-120, PVA-124, PVA-124H, PVA-CS, PVA-CST, PVA-HC, PVA-203, PVA-204, PVA-205, PVA-210, PVA-217, PVA-220, PVA-224, PVA-217EE, PVA-217E, PVA-220E, PVA-224E, PVA-405, PVA-420, PVA-613, and L-8.

The components (what PVA to select, whether additives are added or not) and thickness of the protective layer are optionally determined in consideration of not only protection from oxygen and removal in the development but also fogging, adhesion and scratching resistance. Generally, the more the PVA is hydrolyzed (namely, the more non-substituted polyvinyl units the PVA contains) and the thicker the protective layer is, the more the layer prevents oxygen from permeating. Accordingly, such protective layer is preferred form the viewpoint of sensitivity. If the oxygen permeability is too high, troubles are liable to occur. For example, unfavorable polymerization reactions may proceed in producing or storing the presensitized plate, the fog may be caused in exposure, or the imaging lines may be thickened. The oxygen permeability A at 25° C. under 1 atm preferably satisfied the condition of $0.2 \leqq A \leqq 20$ (cc/m$^2$·day).

The protective layer may contain other components in amounts of several weight percents based on the (co)polymer. For example, glycerin or dipropylene glycol may be added to make the layer flexible; and surface active agents such as anionic agents (e.g., sodium alkyl sulfate, sodium alkyl-sulfonate), amphoteric agents (e.g., alkylamino carboxylates, alkylamino dicarboxylates) and nonionic agents (e.g., polyoxyethylene alkyl phenyl ether) may be added.

The protective layer has a thickness of preferably 0.05 to 5 μm, more preferably 0.1 to 2 μm.

Form the viewpoint of handling the presensitized lithographic printing plate, it is very important to notice the scratching resistance of the protective layer and the adhesion between the protective layer and the image-forming layer in the imaging area. When the protective layer, which is hydrophilic since containing water-soluble polymer, is laminated on the image-recording layer, which is oleophilic, the adhesion between them is often so insufficient that the protective layer is liable to come off. The image-forming layer in the area where the protective layer comes off often suffers troubles. For example, the layer in that area may be insufficiently hardened since the polymerization is inhibited by oxygen.

Various proposals for improving the adhesion have been given. For example, Japanese Patent Provisional Publication No. 49(1974)-70702 and British Patent Publication No. 1,303,578 describe that the image-recording layer is coated with a mixture of hydrophilic polymer (mainly, polyvinyl alcohol) and other polymer (e.g., acrylic emulsion, water-insoluble polyvinyl pyrrolidone vinyl acetate copolymer) in an amount of 20 to 60 wt. % to form a protective layer improved in adhesion. The known proposals like that may be applied to the invention. The protective layer can be formed by the coating procedure described in, for example, U.S. Pat. Publication No. 3,458,311 and Japanese Patent Provisional Publication No. 55(1980)-49729.

Additional functions may be given to the protective layer. For example, colorants (e.g., water-soluble dyes) transmitting IR rays used in exposure but absorbing light in other wavelengths may be incorporated so as to make the presensitized plate less damaged by a safelight without lowering the sensitivity.

(Exposure)

In the lithographic printing process of the invention, the presensitized lithographic printing plate of the invention is imagewise exposed to an IR laser beam.

There is no particular restriction on the IR laser used in the invention. Semi-conductor lasers and solid-state lasers, which emit infrared rays in the wavelength range of 760 to 1,200 nm, are preferably used. The IR laser used in the invention preferably gives an output of 100 mW or more. For shortening the exposure time, a multi-beam laser devise is preferably used.

The exposure time per one pixel is preferably 20 μm or shorter, and the irradiation energy is preferably in the range of 10 to 300 mJ/cm$^2$.

(Printing)

As described above, in the printing process of the invention, the presensitized plate of the invention after imagewise exposed to an IR laser beam is not subjected to any developing process but immediately subjected to the printing process with oily ink and aqueous component supplied.

After exposed to an IR laser beam, the presensitized plate may be installed in a printing machine and then subjected to the printing process without any developing process. Otherwise, after installed in a printing machine, the presensitized plate may be exposed to an IR laser beam and then subjected to printing process without any developing process.

During the printing process performed with oily ink and aqueous component supplied, the image-recording layer in exposed areas having been hardened by exposure receives the oily ink. On the other hand, the image-recording layer in unexposed areas is dissolved (or dispersed) and removed in the supplied oily ink and/or aqueous component, to bare imagewise the hydrophilic surface.

The bared hydrophilic surface receives the aqueous component while the image-recording layer remaining in exposed areas receives the oily ink. In the first step of printing, either the aqueous component or the oily ink may be supplied, but the oily ink is preferably supplied so as not to contaminate the aqueous component with the removed image-recording layer in unexposed areas. As the oily ink and the aqueous component, printing ink and dampening water normally used in the conventional lithographic print can be used, respectively.

In the above way, the presensitized printing plate installed in an offset press is subjected to the press development and successively subjected to the printing process to print many sheets of paper.

Example 1

Preparation of Aluminum Support

An aluminum plate (material: 1050) having 0.3 mm thickness was subjected to oil-removing treatment with 10 wt. % aqueous solution of sodium aluminate at 50° C. for 30 seconds to remove rolling oil on the surface. The surface of the plate was then grained with three brushes having nylon bristles of 0.3 mm diameter and with a suspension of pumice (median size: 25 μm) in water (specific gravity: 1.1 g/cm$^3$), and washed with water. The plate was then immersed for etching in 25% aqueous solution of sodium hydroxide at 45° C. for 9 seconds, washed with water, immersed again in 20% nitric acid at 60° C. for 20 seconds, and washed with water. In this way, the surface was etched in an amount of approx. 3 g/m$^2$.

The plate was then successively roughened electrochemically with alternating current of 60 Hz. The electrolyte used in the treatment was 1 wt. % aqueous solution of nitric acid (containing aluminum ion in 0.5 wt. %) at 50° C. In the treatment, an indirect power cell supplied an alternating current of trapezoidal wave. In each cycle, it took 0.8 msec (TP) for the current to rise from 0 to the peak. The duty ratio was 1:1. The counter electrode was made of carbon while the auxiliary anode was made of ferrite. The current density was 30 A/dM$^2$, and the current supplied from the power cell was made to branch in 5% to the auxiliary anode. The electricity was 175 C/dM$^2$ when the aluminum plate served as the anode in electrolysis with nitric acid. The plate thus treated was sprayed and washed with water.

The plate was further roughened electrochemically in the same manner as the above, except that the electrolyte was 0.5 wt. % aqueous solution of hydrochloric acid (containing aluminum ion in 0.5 wt. %) at 50° C. and that the electricity was 50 C/dM$^2$ when the aluminum plate served as the anode. After sprayed and washed with water, the plate was furthermore electrochemically treated with 15 wt. % sulfuric acid (containing aluminum ion in 0.5 wt. %) under the conditions that the current density was 15 A/dM2, to form a direct current-anodic oxide film of 2.5 g/m$^2$. After washed with water and dried, the plate was treated with 2.5 wt. % aqueous solution of sodium silicate at 30° C. for 10 seconds. The central surface roughness (Ra) of the thus-prepared plate was measured with a 2 μm-diameter needle to find 0.51 μm.

(Preparation of Microcapsule Dispersion)

To 17 g of ethyl acetate, 10 g of adduct of trimethylol propane and xyleneisocyanate (Takenate D-110N, from Mitsui Takeda Chemicals, Inc.), 3.15 g of pentaerythritol acrylate (SR444, from Nippon Kayaku), 0.35 g of the infrared-absorbing dye (1) shown below, 1 g of 3-(N,N-diethylamino)-6-methyl-7-anilinofluoran (ODM, from Yamamoto Chemicals, Inc.) and 0.1 g of the surface active agent (Pionin A-41C, from Takemoto Oil & Fat) were dissolved to prepare an oil phase.

Independently, 40 g of 4 wt. % aqueous solution of polyvinyl alcohol (PVA-205, from Kuraray CO., Ltd.) was prepared as an aqueous phase.

The oil and aqueous phases prepared above were mixed and emulsified with a homogenizer (12,000 rpm) for 10 minutes. The obtained emulsion was added to 25 g of distilled water, and stirred at room temperature for 30 minutes and further stirred at 40° C. for 3 hours. The thus-prepared liquid dispersing microcapsules was diluted with water so that the solid content might be 20 wt. %. The mean size of the microcapsules was 0.3 μm.

Infrared-absorbing dye (1)

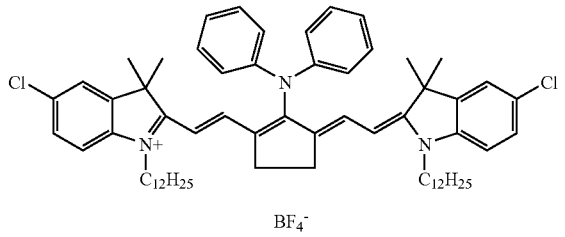

(Formation of Image-Recording Layer)

The coating solution consisting of the following components was prepared and spread with a bar coater to coat the aluminum support, and then dried in an oven at 70° C. for 60 seconds to form the image-recording layer in the amount of 0.8 g/m$^2$ (dry condition). Thus, a presensitized lithographic printing plate was produced.

| Coating solution for image-recording layer | |
|---|---|
| Water | 100 g |
| The microcapsule dispersion (in terms of solid content) | 5 g |
| The following polymerization initiator (1) | 0.5 g |
| The following fluorine-containing surface active agent (1) | 0.2 g |
| The compound (9) | 0.2 g |

Polymerization initiator (1)

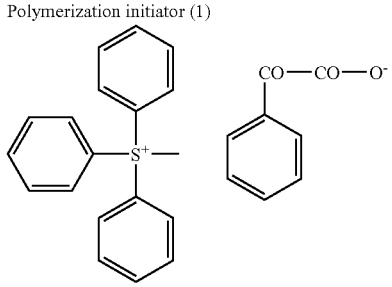

Fluorine-containing surface active agent (1)

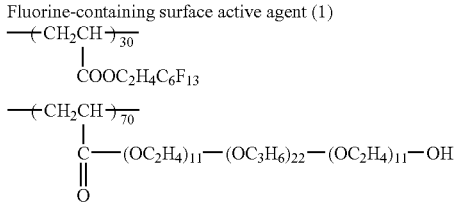

Examples 2-5

The procedure of Example 1 was repeated except that the compound (4), (13), (17) or (33) was used in place of the compound (9), to produce a presensitized lithographic printing plate.

Comparison Example 1

The procedure of Example 1 was repeated except that the compound (9) was not used, to produce a presensitized lithographic printing plate.

Example 6

The coating solution consisting of the following components was prepared and spread with a bar coater to coat the aluminum support, and then dried in an oven at 100° C. for 60 seconds to form the image-recording layer in the amount of 1.0 g/m$^2$ (dry condition). Thus, a presensitized lithographic printing plate was produced.

| Coating solution for image-recording layer | |
|---|---|
| The following infrared-absorbing dye (2) | 0.05 g |
| The following polymerization initiator (1) | 0.2 g |
| The following binder polymer (1) having the average molecular weight of 80,000 | 0.5 g |
| The compound (8) | 0.05 g |
| Isocyanulic acid ethyleneoxide-modified triacrylate (NK ester M-315, from Shin-Nakamura Chemical Co., Ltd.) | 1.0 g |
| The fluorine-containing surface active agent (1) in Example 1 | 0.1 g |
| Methyl ethyl ketone | 18.0 g |

Infrared-absorbing dye (2)

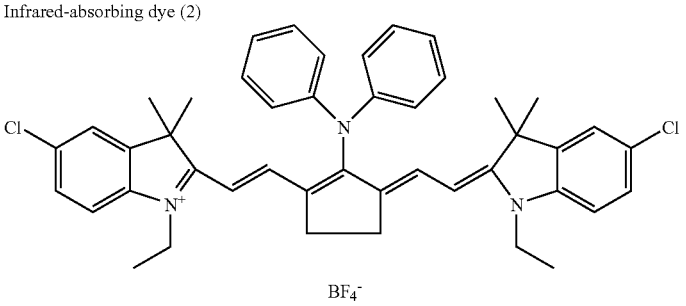

Polymerization initiator (1)

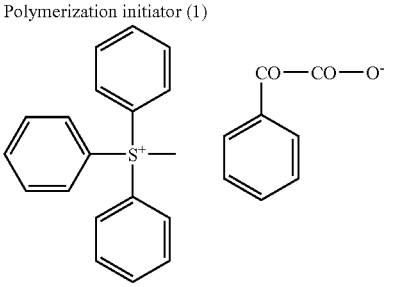

Binder polymer (1)

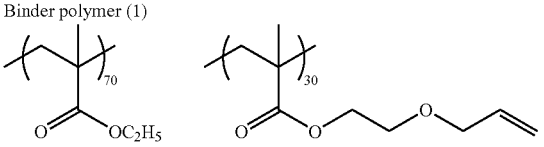

Examples 7-10

The procedure of Example 6 was repeated except that the compound (13), (18), (26) or (30) was used in place of the compound (8), to produce a presensitized lithographic printing plate.

Comparison Example 2

The procedure of Example 6 was repeated except that the compound (8) was not used, to produce a presensitized lithographic printing plate.

Example 11

Preparation of Microcapsule Dispersion

To 17 g of ethyl acetate, 10 g of adduct of trimethylol propane and xylene isocyanate (Takenate D-110N, from Mitsui Takeda Chemicals, Inc.), 3.5 g of pentaerythritol acrylate (SR444, from Nippon Kayaku), 1 g of 3-(N,N-diethylamino)-6-methyl-7-anilinofluoran (ODM, from Yamamoto Chemicals, Inc.) and 0.1 g of sodium dodesylbenzenesulfonate (Pionin A-41C, from Takemoto Oil & Fat) were dissolved to prepare an oil phase.

Independently, 40 g of 4 wt. % aqueous solution of polyvinyl alcohol (PVA-205, from Kuraray CO., Ltd.) was prepared as an aqueous phase.

The oil and aqueous phases prepared above were mixed and emulsified with a homogenizer (12,000 rpm) for 10 minutes. The obtained emulsion was added to 25 g of distilled water, and stirred at room temperature for 30 minutes and further stirred at 40° C. for 3 hours. The thus-prepared liquid dispersing microcapsules was diluted with water so that the solid content might be 20 wt. %. The mean size of the microcapsules was 0.3 μm.

(Formation of Image-Recording Layer)

The coating solution consisting of the following components was prepared and spread with a bar coater to coat the aluminum support, and then dried in an oven at 70° C. for 60 seconds to form the image-recording layer in the amount of 0.8 g/m$^2$ (dry condition). Thus, a presensitized lithographic printing plate was produced.

| Coating solution for image-recording layer | |
|---|---|
| Water | 40 g |
| Propylene glycol monomethyl ether | 50 g |
| Methyl ethyl ketone | 10 g |
| The compound (3) | 0.2 g |
| The following infrared-absorbing dye (3) | 0.15 g |
| The following binder polymer (2) having the average molecular weight of 80,000 | 0.5 g |
| The microcapsule dispersion (in terms of solid content) | 5 g |
| The polymerization initiator (1) in Example 1 | 0.5 g |
| The fluorine-containing surface active agent (1) in Example 1 | 0.1 g |

Infrared-absorbing dye (3)

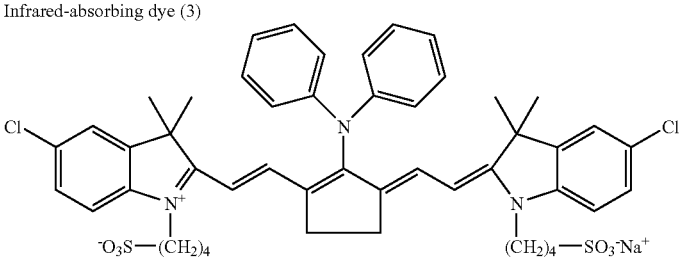

Oleophilic binder polymer (2)

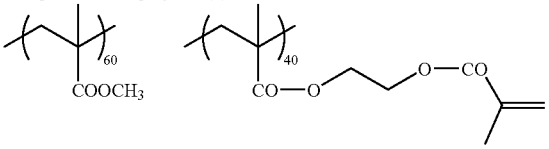

Examples 12-15

The procedure of Example 11 was repeated except that the compound (10), (15), (17) or (34) was used in place of the compound (3), to produce a presensitized lithographic printing plate.

Comparison Example 3

The procedure of Example 11 was repeated except that the compound (3) was not used, to produce a presensitized lithographic printing plate.

(Evaluation of Presensitized Plate)

Each above-produced presensitized plate was imagewise exposed by means of an image setter (Luxel T9000CTP, from Fuji Photo Film Co., Ltd.) equipped with a semiconductor IR laser.

Without subjecting to the developing process, the exposed plate was immediately installed on a cylinder of printing machine (SOR-M, form Heidelberg). As the dampening water, a mixture of etching solution (IF102, from Fuji Photo Film Co., Ltd.)/water [4/96 by volume] was supplied. While black ink (Barius(N), from Dainippon Ink & Chemicals, Inc.) was further supplied, many sheets of paper were printed at the rate of 6,000 sheets per hour.

(1) Sensitivity

In exposing to light, rotation of outer drum was changed to control the energy of printing face. The printing procedure was then carried out to form an image in relief. The minimum exposure required to form the image was measured to estimate the sensitivity. The results are set forth in Table 1.

(2) Removability (Performance in Press Development)

The removability (performance in press development) was evaluated by counting how many sheets of paper were printed until the press development was completed (namely, until the image-forming layer in unexposed areas was removed and hence until ink in the unexposed areas was no longer transferred onto the paper).

(3) Plate Wear

After the press development was completed, the printing was furthermore continued. According as the sheets of printed paper increased, the image-recording layer gradually wore down and less received ink so that the density of ink on the printed paper was lowered. It was counted how many sheets of paper were printed until the ink density (reflection density) faded by 0.1 based on the beginning of printing, and thereby the plate wear was evaluated. The results were set forth in Table 1.

(4) Resistance to stain

After estimating the removability in the above (2), the plate was left for 1 hour. The printing procedure was then restarted, and it was counted how many sheets of paper were printed until the printing was carried out in a normal way that only the areas corresponding to the exposed areas received the ink and there was no ink on the areas corresponding to the unexposed areas, whereby the resistance to stain was evaluated. The results were set forth in Table 1.

(5) Resistance to Chemicals

The procedure of the above (3) was repeated except that the surface of image-recording layer was brought into contact with multi-cleaner (from Fuji Photo Film Co., Ltd.) for 1 minute and wiped with water every 5,000 sheets of paper. It was counted how many sheets of paper were printed until the ink density (reflection density) faded by 0.1 based on the beginning of printing, and thereby the resistance to chemicals was evaluated. The results were set forth in Table 1.

TABLE 1

| Presensitized lithographic plate | Sensitivity (minimum exposure)/ mJ/cm$^2$ | Removability/ sheets | Plate wear/ sheets | Resistance to stain/ sheets | Resistance to chemicals/ sheets |
|---|---|---|---|---|---|
| Example 1 | 70 | 40 | 50,000 | 35 | 30,000 |
| Example 2 | 70 | 35 | 50,000 | 40 | 25,000 |
| Example 3 | 70 | 40 | 53,000 | 35 | 25,000 |
| Example 4 | 70 | 30 | 55,000 | 40 | 35,000 |
| Example 5 | 70 | 35 | 45,000 | 35 | 35,000 |
| Example 6 | 50 | 45 | 55,000 | 40 | 40,000 |
| Example 7 | 60 | 45 | 50,000 | 35 | 35,000 |
| Example 8 | 50 | 40 | 45,000 | 35 | 25,000 |
| Example 9 | 50 | 35 | 50,000 | 35 | 40,000 |
| Example 10 | 60 | 30 | 55,000 | 40 | 35,000 |
| Example 11 | 60 | 25 | 60,000 | 25 | 30,000 |
| Example 12 | 70 | 25 | 55,000 | 25 | 35,000 |
| Example 13 | 70 | 30 | 50,000 | 25 | 30,000 |
| Example 14 | 70 | 30 | 60,000 | 25 | 40,000 |
| Example 15 | 70 | 35 | 50,000 | 30 | 25,000 |
| Comp. Ex. 1 | 200 | 50 | 5,000 | 150 | ≦1,000 |
| Comp. Ex. 2 | 200 | 50 | 6,000 | 130 | ≦1,000 |
| Comp. Ex. 3 | 200 | 50 | 7,000 | 110 | ≦1,000 |

We claim:

1. A lithographic printing process which comprises the steps of:

imagewise scanning with a laser a presensitized lithographic plate which comprises a hydrophilic support and an image-recording layer containing a polymerization initiator, an ethylenically unsaturated polymerizable compound having no adherence to the hydrophilic support, and an ethylenically unsaturated polymerizable compound having adherence to the hydrophilic support and a molecular structure comprising a polyoxyalkylene group to polymerize the ethylenically unsaturated polymerizable compounds within the exposed area;

removing the image-recording layer within the unexposed area from the lithographic plate mounted on a cylinder of a printing press; and then printing an image with the lithographic plate mounted on the cylinder of the printing press, and wherein the ethylenically unsaturated polymerizable compound having adherence is represented by the formula (I):

(I)

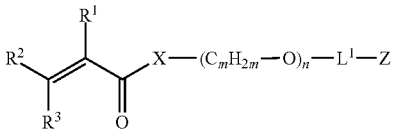

wherein each of $R^1$, $R^2$ and $R^3$ independently is hydrogen, a halogen atom or an alkyl group having 1 to 6 carbon atoms;

X is oxygen or imino;

m is an integer of 2 to 6; n is an integer of 2 to 20; $L^1$ is a single bond or a divalent linking group selected from the group consisting of a divalent aliphatic group, a divalent aromatic group, a divalent heterocyclic group, oxygen, sulfur, imino, a substituted imino group, carbonyl and a combination thereof; and Z is an acidic group having pKa of not higher than 7 selected from the group consisting of phenolic hydroxyl, —COOH, —$SO_3H$, —$OSO_3H$, —$CONHSO_2$—, —$SO_2NHSO_2$— and —$COCH_2COCH_3$ or an onium group selected from the group consisting of an ammonium group, a phosphonium group and a sulfonium group.

2. The lithographic printing process as defined in claim 1, wherein the image-recording layer further contains an infrared absorbing dye, and the presensitized lithographic plate is scanned with an infrared laser.

3. The lithographic printing process as defined in claim 1, wherein the ethylenically unsaturated polymerizable compound having no adherence has at least two ethylenically unsaturated groups.

4. The lithographic printing process as defined in claim 1, wherein the ethylenically unsaturated polymerizable compound having no adherence is contained in microcapsules, which are dispersed in the image-recording layer.

5. The lithographic printing process as defined in claim 1, wherein each of $R^1$, $R^2$ and $R^3$ independently is hydrogen or an alkyl group having 1 to 3 carbon atoms.

6. The lithographic printing process as defined in claim 1, wherein X is oxygen.

7. The lithographic printing process as defined in claim 1, wherein the hydrophilic support comprises an aluminum plate.

8. The lithographic printing process as defined in claim 1, wherein $L^1$ is a single bond or a divalent linking group selected from the group consisting of a divalent aliphatic group, a divalent aromatic group, a divalent heterocyclic group, imino, a substituted imino group, carbonyl and a combination thereof.

9. A presensitized lithographic plate which comprises a hydrophilic support and an image-recording layer containing a polymerization initiator, an ethylenically unsaturated polymerizable compound having no adherence to the hydrophilic support, and an ethylenically unsaturated polymerizable compound having adherence to the hydrophilic support and a molecular structure comprising a polyoxyalkylene group, wherein the image-recording layer is removable with an ink or dampening water, and wherein the ethylenically unsaturated polymerizable compound having adherence is represented by the formula (I):

(I)

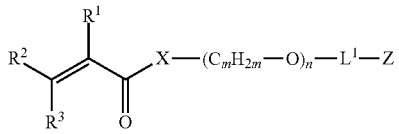

wherein each of $R^1$, $R^2$ and $R^3$ independently is hydrogen, a halogen atom or an alkyl group having 1 to 6 carbon atoms;

X is oxygen or imino;

m is an integer of 2 to 6; n is an integer of 2 to 20; $L^1$ is a single bond or a divalent linking group selected from the group consisting of a divalent aliphatic group, a divalent aromatic group, a divalent heterocyclic group, oxygen, sulfur, imino, a substituted imino group, carbonyl and a combination thereof; and Z is an acidic group having pKa of not higher than 7 selected from the group consisting of phenolic hydroxyl, —COON, —$SO_3H$, —$OSO_3H$, —$CONHSO_2$—, —$SO_2NHSO_2$— and —$COCH_2COCH_3$ or an onium group selected from the group consisting of an ammonium group, a phosphonium group and a sulfonium group.

10. The presensitized lithographic plate as defined in claim 9, wherein the ethylenically unsaturated polymerizable compound having no adherence to the hydrophilic support is contained in microcapsules which are dispersed in the image-recording layer.

11. The presensitized lithographic plate as defined in claim 9, wherein the image-recording layer further contains an infrared absorbing dye.

12. The presensitized lithographic plate as defined in claim 9, wherein $L^1$ is a single bond or a divalent linking group selected from the group consisting of a divalent aliphatic group, a divalent aromatic group, a divalent heterocyclic group, imino, a substituted imino group, carbonyl and a combination thereof.

* * * * *